US011819865B2

(12) United States Patent
Weir et al.

(10) Patent No.: US 11,819,865 B2
(45) **Date of Patent: *Nov. 21, 2023**

(54) WATER-BASED PYROTECHNIC ILLUSION

(71) Applicant: Royal Caribbean Cruises Ltd., Miami, FL (US)

(72) Inventors: Nicholas Weir, Davie, FL (US); Steven Michelman, Las Vegas, NV (US); Daniel Comins, Las Vegas, NV (US); Zachary Cook, Las Vegas, NV (US)

(73) Assignee: Royal Caribbean Cruises Ltd., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/929,642

(22) Filed: Sep. 2, 2022

(65) Prior Publication Data

US 2023/0069284 A1 Mar. 2, 2023

Related U.S. Application Data

(63) Continuation of application No. 17/099,528, filed on Nov. 16, 2020, now Pat. No. 11,433,417.

(Continued)

(51) Int. Cl.

| | |
|---|---|
| ***B05B 17/08*** | (2006.01) |
| ***F21S 9/02*** | (2006.01) |
| ***F21S 10/00*** | (2006.01) |
| ***F21S 10/04*** | (2006.01) |
| ***F21S 10/06*** | (2006.01) |

(Continued)

(52) U.S. Cl.

CPC ..... *B05B 17/08* (2013.01); *B05B 3/02* (2013.01); *B05B 3/06* (2013.01); *F21S 9/02* (2013.01); *F21S 10/002* (2013.01); *F21S 10/04* (2013.01); *F21S 10/06* (2013.01); *F21V 23/0435* (2013.01); *A63J 5/023* (2013.01); *F21W 2121/02* (2013.01)

(58) Field of Classification Search

CPC ..... A63J 5/023; A63J 5/025; F21S 10/002; F21W 2121/02; B05B 17/08; B05B 17/085

See application file for complete search history.

(56) References Cited

U.S. PATENT DOCUMENTS 1,929,825 A 10/1933 Requa
1,982,315 A 11/1934 Lundberg (Continued)

FOREIGN PATENT DOCUMENTS

WO WO 2017/117296 7/2017

OTHER PUBLICATIONS

Extended European Search Report in European App. No. EP 20208441.4 dated Mar. 22, 2021 (8 pgs).

*Primary Examiner* — Alexander K Garlen

(74) *Attorney, Agent, or Firm* — Knobbe, Martens, Olson & Bear, LLP

(57) ABSTRACT

Systems and methods for firework water illusions are disclosed. In one aspect, a device for creating an illusion of rotary pyrotechnics includes at least one nozzle configured to rotate about an axis of the device and spray water in a radial direction while rotating. The device can also include a water supply configured to provide the water to the at least one nozzle and a lighting system configured to illuminate the water sprayed from the at least one nozzle to create an illusion of rotary pyrotechnics.

31 Claims, 15 Drawing Sheets
(1 of 15 Drawing Sheet(s) Filed in Color)

Related U.S. Application Data

(60) Provisional application No. 62/937,682, filed on Nov. 19, 2019.

(51) Int. Cl.

| | |
|---|---|
| ***F21V 23/04*** | (2006.01) |
| ***B05B 3/06*** | (2006.01) |
| ***B05B 3/02*** | (2006.01) |
| ***A63J 5/02*** | (2006.01) |
| ***F21W 121/02*** | (2006.01) |

(56) References Cited

U.S. PATENT DOCUMENTS

| | | | | |
|---|---|---|---|---|
| 2,593,517 | A * | 4/1952 | Angulo | B05B 3/06 239/19 |
| 2,883,113 | A | 4/1959 | Horvath | |
| 11,433,417 | B2 | 9/2022 | Weir et al. | |
| 2003/0168523 | A1 | 9/2003 | Lin | |
| 2007/0037470 | A1 * | 2/2007 | Rothan | A63H 33/22 446/176 |
| 2008/0277493 | A1 * | 11/2008 | Liao | F21S 9/02 239/20 |
| 2009/0250528 | A1 * | 10/2009 | Schnuckle | B05B 17/08 239/18 |
| 2011/0132993 | A1 | 6/2011 | Wiseman et al. | |
| 2019/0060944 | A1 | 2/2019 | Fuller et al. | |
| 2019/0143238 | A1 | 5/2019 | Lunde et al. | |
| 2019/0143240 | A1 | 5/2019 | Lunde et al. | |
| 2020/0316620 | A1 * | 10/2020 | Xu | F21S 10/002 |

* cited by examiner

100

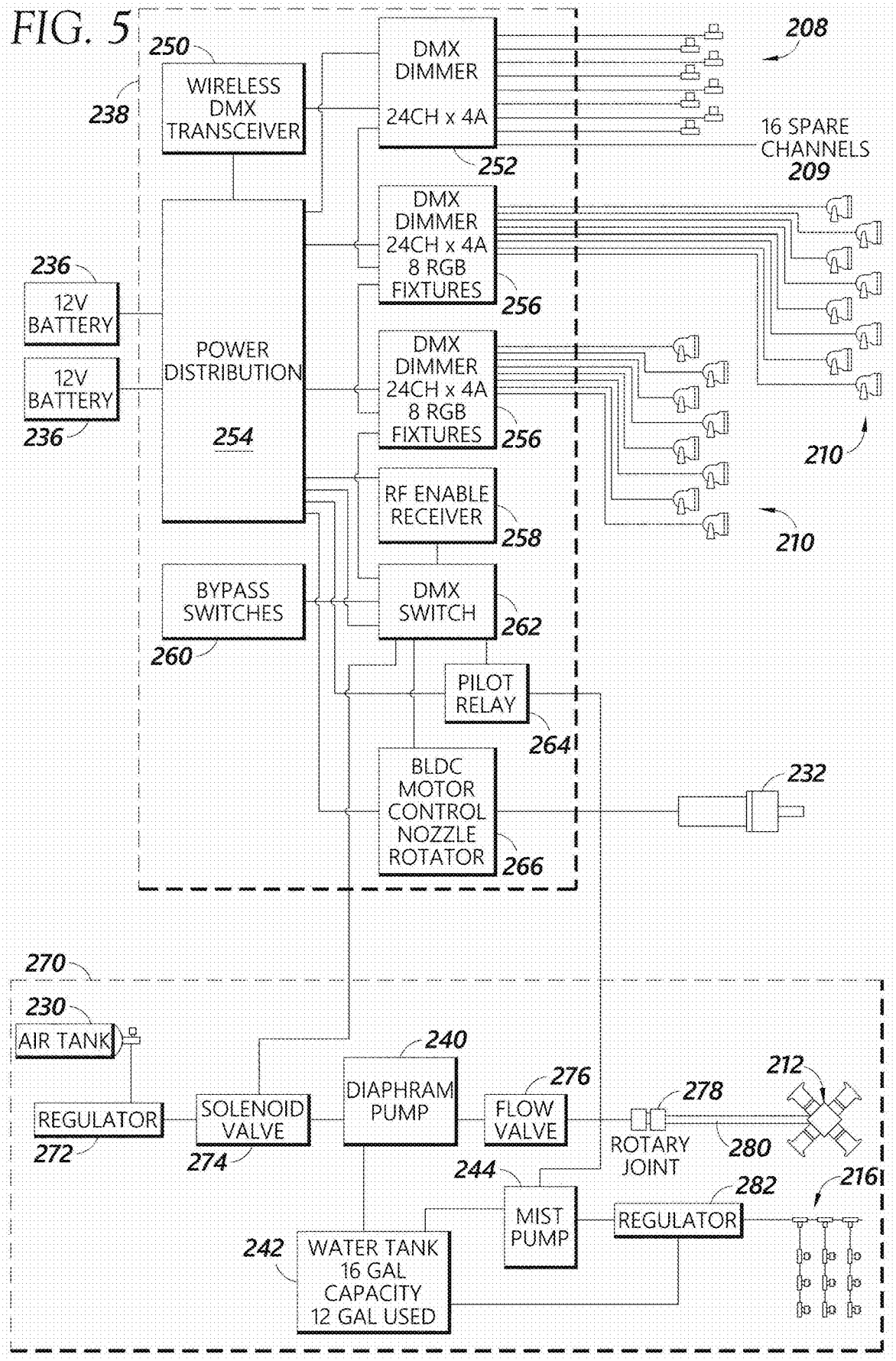
FIG. 5
250
WIRELESS DMX TRANSCEIVER
238
DMX DIMMER 24CH x 4A
252
208
16 SPARE CHANNELS
209
DMX DIMMER 24CH x 4A 8 RGB FIXTURES
256
236
12V BATTERY
12V BATTERY
236
POWER DISTRIBUTION
254
DMX DIMMER 24CH x 4A 8 RGB FIXTURES
256
210
210
RF ENABLE RECEIVER
258
BYPASS SWITCHES
260
DMX SWITCH
262
PILOT RELAY
264
BLDC MOTOR CONTROL NOZZLE ROTATOR
266
232
270
230
AIR TANK
REGULATOR
272
SOLENOID VALVE
274
240
DIAPHRAM PUMP
276
FLOW VALVE
278
ROTARY JOINT
280
212
244
MIST PUMP
282
REGULATOR
216
242
WATER TANK 16 GAL CAPACITY 12 GAL USED

400

400

WATER-BASED PYROTECHNIC ILLUSION

CROSS-REFERENCE TO RELATED APPLICATION(S)

This application is a continuation of U.S. application Ser. No. 17/099,528, filed Nov. 16, 2020, which claims the benefit of U.S. Provisional Application No. 62/937,682, filed Nov. 19, 2019, all of which are hereby incorporated by reference in their entirety.

BACKGROUND

Technological Field

The present application relates to pyrotechnic water illusions, and in particular, to creating an illusion of rotary pyrotechnics using water.

Description of the Related Technology

Fireworks are a class of pyrotechnic devices used in many settings for aesthetic and entertainment purposes. In addition to being used as part of a traditional fireworks display, fireworks can also be used to enhance other entertainment productions, including live shows or performances, events, parties, etc. While the aesthetic aspects (e.g., the colors, brightness, acoustics, etc.) of fireworks may be desirable in various settings, fireworks also present a number of drawbacks that prevent fireworks form being used in certain environments. For example, fireworks may present a fire hazard, limiting the number of environments in which fireworks or other pyrotechnics can be safely used.

SUMMARY

The system, method, and devices of this disclosure each have several innovative aspects, no single one of which is solely responsible for its desirable attributes disclosed herein. Without limiting the scope of this disclosure, its more prominent features will now be discussed briefly. After considering this discussion, and particularly after reading the section entitled "Detailed Description" one will understand how the features of this disclosure provide advantages over other personalized recommendation solutions.

In a first aspect, a device for creating an illusion of rotary pyrotechnics is provided. The device can include at least one nozzle configured to rotate about an axis of the device and spray water in a radial direction while rotating; a water supply configured to provide the water to the at least one nozzle; and a lighting system configured to illuminate the water sprayed from the at least one nozzle to create an illusion of rotary pyrotechnics.

In some embodiments, the device can further include at least one mister surrounding the at least one nozzle from a front view, the at least one mister configured to receive water from the water supply, atomize the water into droplets, and spray the droplets in the radial direction. The lighting system can include a plurality of strobe lights positioned along a perimeter of the device, the strobe lights configured to illuminate the water sprayed from the at least one nozzle so as to create an illusion of light generated by rotary pyrotechnics; and a plurality of spot lights configured to illuminate the droplets sprayed from the at least one mister so as to create an illusion of smoke generated by rotary pyrotechnics. The at least one mister can be further configured to continue spraying the droplets after the at least one nozzle has stopped spraying water. The at least one nozzle can be arranged to face the radial direction such that the at least one nozzle is configured to spray the water in the radial direction, and the spot lights can be arranged to face a direction forming an angle with the radial direction such that the spot lights are configured to illuminate the droplets sprayed from the at least one mister and the at least one nozzle.

In some embodiments, the device can further include a main shaft coaxial with the axis of the device and attached to the at least one nozzle; and a motor configured to spin the shaft so as to rotate the at least one nozzle about the axis.

In some embodiments, the device can further include a frame housing the water supply, wherein the water supply comprises a water tank located within the frame; a compressed air tank configured to store compressed air; a pneumatic water pump configured to pump water from the water tank to the at least one nozzle using the compressed air; and a rigging attachment configured to be coupled to a cable system, the cable system configured to move the device in space, wherein the device is configured to create the illusion of rotary pyrotechnics without any external water supply. The device can further include a battery configured to power the lighting system; a wireless receiver configured to receive a command to initiate the illusion of rotary pyrotechnics; and a controller configured control the pneumatic water pump and the lighting system to initiate the illusion of rotary pyrotechnics in response to the command received via the wireless receiver. The water tank can have a capacity to supply the at least one nozzle with the water to create the illusion of rotary pyrotechnics for at least 15 seconds. The device can have a weight of less than 400 pounds.

In some embodiments, the device can further include a frame defining a perimeter of the device, the at least one nozzle and the lighting system attached to the frame, the frame configured to be attached to a fixed structure configured to support the device, wherein the water supply comprises a connector configured to receive the water from a water tank external to the device. The device can further include a main shaft coaxial with the axis of the device and attached to the at least one nozzle; and a motor configured to spin the shaft so as to rotate the at least one nozzle about the axis.

In some embodiments, the device can further include a fog machine configured to emit a vapor from one or more apertures in the device, the fog machine being synchronized with the at least one nozzle to emit the vapor at the same time as the at least one nozzle sprays the water.

In some embodiments, the device can be configured to create the illusion of rotary pyrotechnics without the use of pyrotechnics.

In another aspect, a device for creating an illusion of rotary pyrotechnics the device comprising: a frame forming a perimeter of the device; at least one nozzle configured to rotate about an axis of the frame and spray water in a radial direction while rotating; a water tank housed within the frame and configured to provide water to the at least one nozzle; and a lighting system configured to illuminate the water sprayed from the at least one nozzle to create an illusion of rotary pyrotechnics.

In some embodiments, the device can further include at least one mister surrounding the at least one nozzle from a front view, the at least one mister configured to receive water from the water tank, atomize the water into droplets, and spray the droplets in the radial direction. The lighting system can include a plurality of strobe lights positioned along a perimeter of the device, the strobe lights configured to illuminate the water sprayed from the at least one nozzle so as to create an illusion of light generated by rotary pyrotechnics; and a plurality of spot lights configured to illuminate the droplets sprayed from the at least one mister so as to create an illusion of smoke generated by rotary pyrotechnics. The at least one mister can be further configured to continue spraying the droplets after the at least one nozzle has stopped spaying water. The at least one nozzle can be arranged to face the radial direction such that the at least one nozzle is configured to spray the water in the radial direction, and the spot lights can be arranged to face a direction forming an angle with the radial direction such that the spot lights are configured to illuminate the droplets sprayed from the at least one mister and the at least one nozzle.

In some embodiments, the device can further include a main shaft coaxial with the axis of the device and attached to the at least one nozzle; and a motor configured to spin the shaft so as to rotate the at least one nozzle about the axis.

In some embodiments, the device can further include a compressed air tank configured to store compressed air; a pneumatic water pump configured to pump water from the water tank to the at least one nozzle using the compressed air; and a rigging attachment configured to be coupled to a cable system, the cable system configured to move the device in space, wherein the device is configured to create the illusion of rotary pyrotechnics without any external water supply. The device can further include a battery configured to power the lighting system; a wireless receiver configured to receive a command to initiate the illusion of rotary pyrotechnics; and a controller configured control the pneumatic water pump and the lighting system to initiate the illusion of rotary pyrotechnics in response to the command received via the wireless receiver. The water tank can have a capacity to supply the at least one nozzle with the water to create the illusion of rotary pyrotechnics for at least 15 seconds. The device can have a weight of less than 400 pounds.

In some embodiments, the device can further include a fog machine configured to emit a vapor from one or more apertures in the device, the fog machine being synchronized with the at least one nozzle to emit the vapor at the same time as the at least one nozzle sprays the water.

In some embodiments, the device can be configured to create the illusion of rotary pyrotechnics without the use of pyrotechnics.

In yet another aspect, device for creating an illusion of rotary pyrotechnics, the device comprising: a frame forming a perimeter of the device, the frame configured to be supported by a fixed structure; at least one nozzle attached to the frame and configured to rotate about an axis of the frame and spray water in a radial direction while rotating; a water supply connector configured to receive water from a water tank external to the device and provide the water to the at least one nozzle; and a lighting system configured to illuminate the water sprayed from the at least one nozzle to create an illusion of rotary pyrotechnics.

In some embodiments, the device can further include at least one mister surrounding the at least one nozzle from a front view, the at least one mister configured to receive water from the water supply, atomize the water into droplets, and spray the droplets in the radial direction. The lighting system can further include a plurality of strobe lights positioned along a perimeter of the device, the strobe lights configured to illuminate the water sprayed from the at least one nozzle so as to create an illusion of light generated by rotary pyrotechnics; and a plurality of spot lights configured to illuminate the droplets sprayed from the at least one mister so as to create an illusion of smoke generated by rotary pyrotechnics. The at least one mister can be further configured to continue spraying the droplets after the at least one nozzle has stopped spraying water. The at least one nozzle can be arranged to face the radial direction such that the at least one nozzle is configured to spray the water in the radial direction, and the spot lights can be arranged to face a direction forming an angle with the radial direction such that the spot lights are configured to illuminate the droplets sprayed from the at least one mister and the at least one nozzle.

In some embodiments, the device can further include a main shaft coaxial with the axis of the device and attached to the at least one nozzle; and a motor configured to spin the shaft so as to rotate the at least one nozzle about the axis.

In some embodiments, the frame of the device can define a perimeter of the device, the at least one nozzle and the lighting system attached to the frame, the frame configured to be attached to a fixed structure configured to support the device. The device can further include a main shaft coaxial with the axis of the device and attached to the at least one nozzle; and a motor configured to spin the shaft so as to rotate the at least one nozzle about the axis.

In some embodiments, the device can further include a fog machine configured to emit a vapor from one or more apertures in the device, the fog machine being synchronized with the at least one nozzle to emit the vapor at the same time as the at least one nozzle sprays the water.

In some embodiments, the device can be configured to create the illusion of rotary pyrotechnics without the use of pyrotechnics.

BRIEF DESCRIPTION OF THE DRAWINGS

The disclosed aspects will hereinafter be described in conjunction with the appended drawings and appendices, provided to illustrate and not to limit the disclosed aspects, wherein like designations denote like elements. The patent or application filed contains at least one drawing executed in color. Copies of this patent or patent application publication with color drawings will be provided by the Office upon request and payment of the necessary fee.

FIG. 5 is an example block diagram illustrating an example control system for the device of FIG. 2A in accordance with aspects of this disclosure.

DETAILED DESCRIPTION

Overview

Pyrotechnics such as fireworks are often used in many settings for aesthetic and entertainment purposes including various types of entertainment productions. Fireworks take many forms to produce certain effects, including at least noise, light, smoke, and floating materials (for example, confetti). However, since fireworks involve igniting a pyrotechnic device in a controlled manner, there are a number of environments and settings which may not be suitable for fireworks. For example, cruise ships may provide entertainment to passengers which often includes one or more live shows. Live show production for cruise ships has traditionally been restricted from the use of fireworks due to regulations implemented to ensure safety onboard the ship.

Another example type of entertainment production are aquatic shows, which may involve acrobatics performed over a large pool. Aquatic shows, which are traditionally performed in a permanent theater, are being adapted for performance on cruise ships due to their continued popularity. The use of fireworks in such performances, particularly in the cruise ship environment, may be relatively dangerous and/or prohibited. Thus, there is a demand for the recreation of fireworks using an illusion to recreate at least some of the effects of fireworks without the drawbacks, such as the fire hazard associated with traditional fireworks. In the context of aquatic shows, a water-based illusion may be particularly advantageous since these environments may be equipped with hardware that can be used to control such a water-based illusion (e.g., having proper drainage). In addition, the use of a physical medium (e.g., water or another liquid) to recreate fireworks may be more engaging to an audience compared to, for example, a simple visual projection of the image of fireworks onto a screen.

Yet another environment in which such a water based firework illusion may be so-called "pool parties" which are popular in entertainment centers such as Las Vegas. These parties may include live music, DJs, numerous swimming pools, etc. In this setting, the use of fireworks may also be a fire hazard, and thus, the use of a water-based firework illusion may be desirable.

Figure 1:
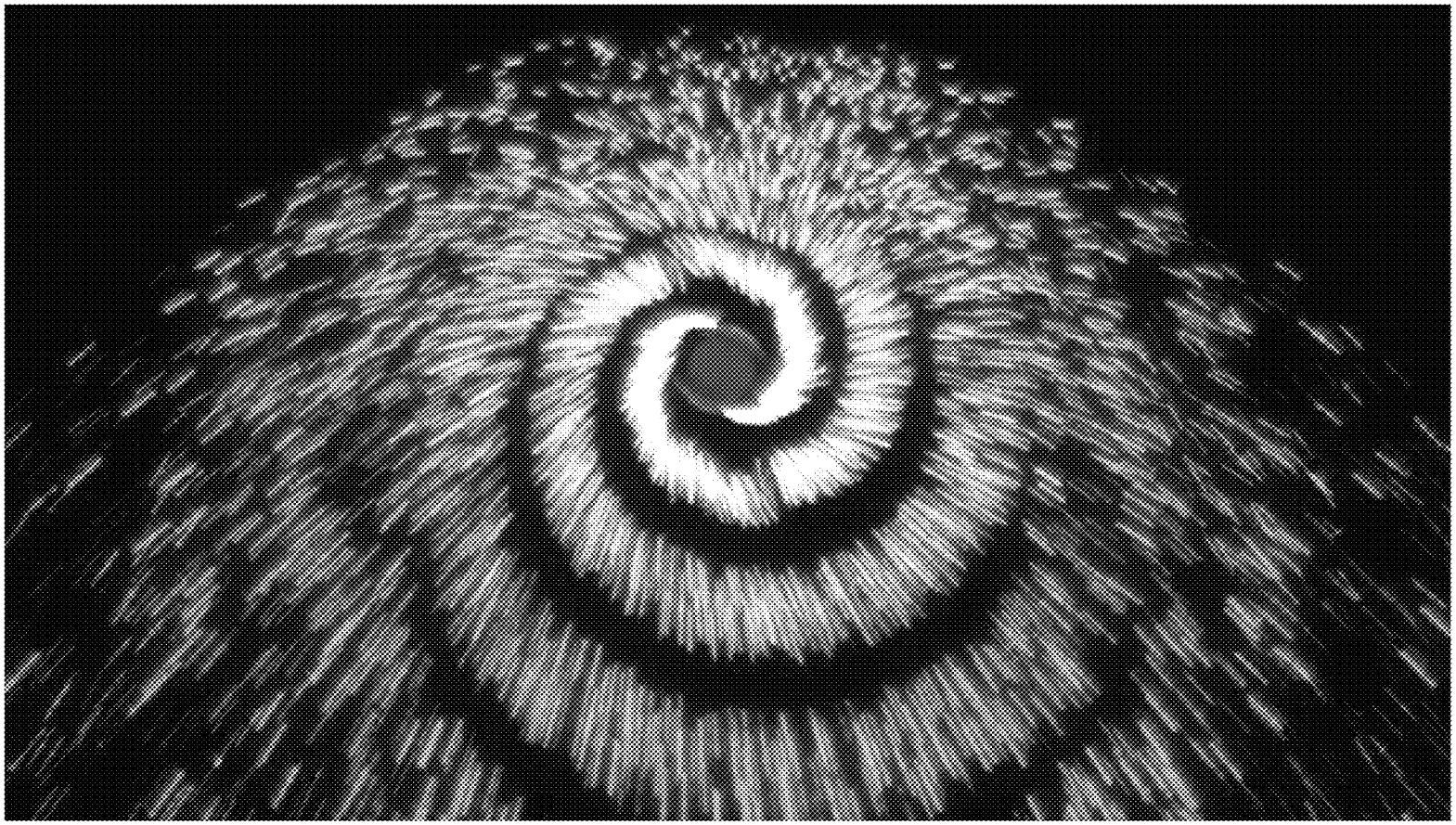
FIG. 1 shows the visual effects of Catherine wheel fireworks in accordance with aspects of this disclosure.

Aspects of this disclosure relate to a water- or other liquid-based pyrotechnic illusion that can emulate one or more of the effects associated with traditional fireworks without creating the same safety concerns connected to the use of pyrotechnics. Although embodiments of this disclosure are described in connection with pyrotechnic illusions which are water-based, aspects of this disclosure are not limited thereto. For example, other liquids can also be used. In certain implementations, a liquid may be selected based on its viscosity, reflective properties, refractive properties, or any other properties that can affect the visual aspects of a pyrotechnic illusion. One type of pyrotechnic which may be emulated using water are rotary pyrotechnics, such as Catherine wheel fireworks (also referred to as a pinwheel). FIG. 1 shows the visual effects of Catherine wheel fireworks in accordance with aspects of this disclosure.

As shown in FIG. 1, the Catherine wheel firework 100 may include one or more rockets mounted at an angle with respect to a central axle of the firework body. In the FIG. 1 embodiment, two rocket-type fireworks are shown mounted to opposing sides of the firework body. As the rocket fireworks expel exhaust while they burn, the thrust provided by the rocket(s) spins the body of the Catherine wheel, creating a spiral pattern of sparks as the sparks are propelled from the spinning rockets.

There are a number of design challenges that are associated with creating an illusion of a Catherine wheel firework using water and light. For example, the visual patterns of a Catherine wheel firework, including the spiral spark pattern and bright lighting, may be difficult to recreate using water and electrical lighting systems. In addition, Catherine wheel fireworks are somewhat chaotic, including large and frequent variations in the timing, intensity, and color of the visual effects. Fireworks also create smoke, which can enhance the illusion if recreated effectively.

Figure 2A:
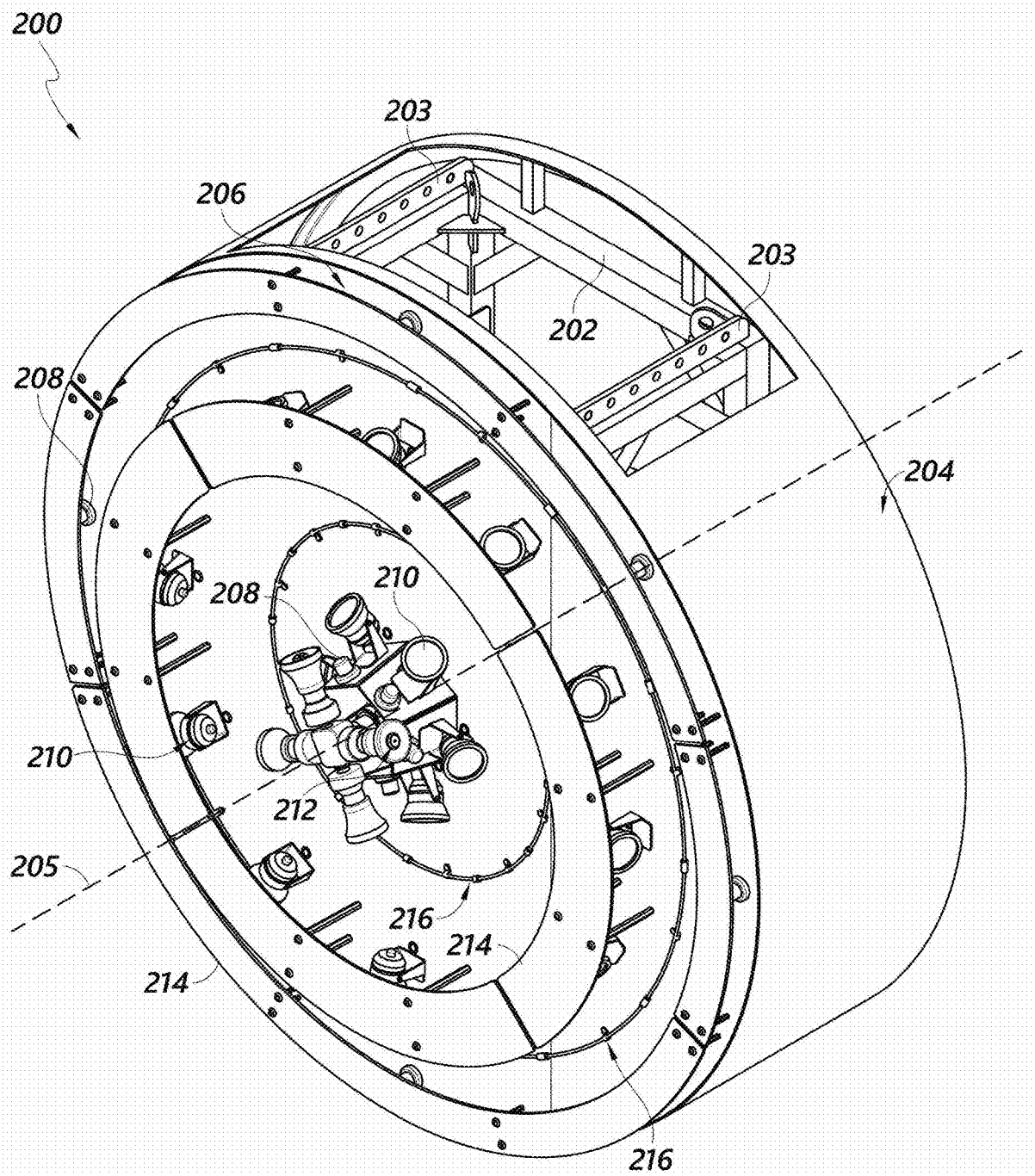
FIG. 2A is a partial cutaway perspective view of a device for creating an illusion of rotary pyrotechnics in accordance with aspects of this disclosure.

FIG. 2A is a partial cutaway perspective view of a device 200 for creating an illusion of rotary pyrotechnics in accordance with aspects of this disclosure. In particular, the device 200 includes a frame 202, an outer surface 204 and 206, a plurality of strobe lights 208, a plurality of spot lights 210, a plurality of water nozzles 212, one or more panels 214, and one or more misters 216. As described in detail herein, the device 200 can be configured to create the illusion of rotary pyrotechnics without the use of pyrotechnics, thereby producing at least some of the effects associated with rotary pyrotechnics without the safety hazards produced by pyrotechnics. Devices in accordance with aspects of this disclosure can include all of the associated listed features or a subset of the listed features.

Figure 2B:
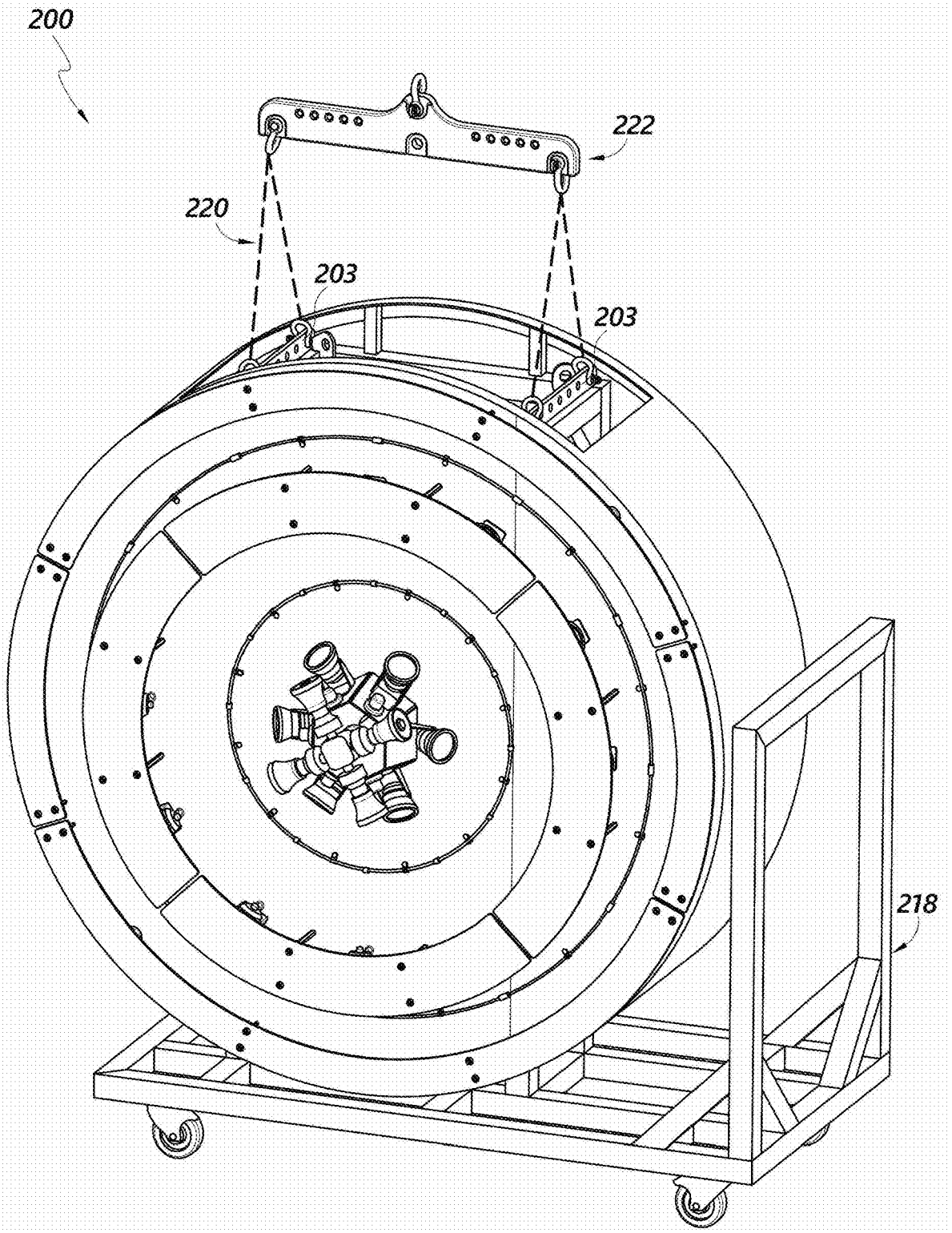
FIG. 2B is a partial cutaway perspective view of the device of FIG. 2A, illustrating one embodiment of equipment that can be used to transport the device.

FIG. 2B is a partial cutaway perspective view of the device 200 of FIG. 2A, illustrating one embodiment of equipment that can be used to transport the device 200. As shown in FIG. 2B, the device 200 can be configured to be placed on a removable cart 218, for example, when not in use. In addition, the device 200 can be configured to be connected to rigging lines 220 which may be supported by a spreader bar 222.

In the FIG. 2A embodiment, the frame 202 includes a rigging attachment 203, which can be used to attach the device to one or more cables (as shown in FIG. 2B) configured to raise the device up to an operational height. In some embodiments, the device 200 can be attached to a cable system (such as a 3D dynamic flying system) which can be used to position the device 200 at any location within a working volume using a set of cables and pulleys, as described herein.

The outer surface 204 may be formed on the sides and back of the device 200 and includes a grey cladding in the illustrated embodiment, however, in other embodiments, the outer surface 204 can include any material designed to cover and protect the internal components of the device 200. For example, the outer surface 204 may be water resistant in order to substantially prevent water sprayed from the device 200 from reaching electrical internal components. The outer surface 206 on the front of the device 200 may also be formed of a water resistant material. However, since the rotary pyrotechnic illusion may be viewed from the front of the device, the outer surface 206 may also have a certain amount of reflectance configured to reflect at least some of the light emitted from a lighting system, including the strobe lights 208 and/or the spot lights 210, to enhance the illusion.

In the illustrated embodiment, four water nozzles 212 are mounted on a rotating main shaft 232 (shown in FIG. 4), however, a greater or fewer number of water nozzles 212 can be used in other embodiments. The water nozzles 212 are configured to rotate about an axis 205 of the device 200 and spray water in a radial direction while rotating. Thus, the water nozzles 212 are configured to spray water in a pattern that emulates the exhaust expelled by a rocket firework, while the water nozzles 212 are spun around the main shaft 232 such that the sprayed water forms a spiral pattern about the axis 205 of the device 200. The water nozzles 212 are arranged to face a radial direction of the device 200 such that the water nozzles 212 are configured to spray the water in the radial direction (e.g., radially outward relative to the axis 205 of the device 200).

The strobe lights 208 and the spot lights 210 are arranged to illuminate the water sprayed from the water nozzles 212 to manipulate the visual impact of the water sprayed from the water nozzles 212 in order to create an illusion of rotary pyrotechnics, in particular, creating an illusion of the light produced by rotary pyrotechnics. More specifically, since fireworks are typically used in a relatively dark environment, the water sprayed from the water nozzles 212 forming a spiral pattern may not be sufficient alone to emulate the light produced by a rotary pyrotechnic. Thus, the strobe lights 208 and spot lights 210 are configured to illuminate the water pattern produced by the water nozzles 212 in order to emulate the lighting of a traditional rotary pyrotechnic.

In some embodiments, the strobe lights 208 are configured to produce flashes of light in order to at least partially emulate the chaotic nature of pyrotechnic exhaust. The relatively intense flashes of light provided by the strobe lights 208 can recreate some of the intensity associated with pyrotechnics, such as the rockets of a Catherine wheel firework. The strobe lights 208 can be positioned along a perimeter of the device 200 as shown in FIG. 2A. Alternatively, or in addition to strobe lights 208 positioned along the perimeter of the device 200, strobe lights 208 may be positioned centrally near the axis 205 and behind the water nozzles 212. The embodiment of FIG. 2A includes a combination of centrally located strobe lights 208 and strobe lights 208 disposed along the perimeter of the device 200.

For example, the strobe lights 208 can be implemented using technology similar to emergency vehicle strobe lights, which may be implemented as LEDs. It is desirable that the strobe lights 208 and the spot lights 210 have a certain degree of water resistance so that they are not damaged by the water sprayed to create the rotary pyrotechnic effects. The light emitted from the strobe lights 208 can reflect off of the outer surface 206 on the front of the device 200. By forming the outer surface 206 on the front of the device 200 using a reflective material, such as aluminum, the reflected strobe light can provide a desirable sparkling effect to aid in the rotary pyrotechnic illusion.

In addition, the spot lights 210 are configured provide a level of background lighting to the water spray pattern. In some embodiments, the spot lights 210 are configured to change color, which can be used to emulate different colored fireworks. Thus, in some embodiments, the spot lights 210 may be RGB programmable lights that can be programmed to vary in intensity and/or color to recreate the visuals of a rotary pyrotechnic. The spot lights 210 can also be arranged to face a direction forming an angle with a radial direction of the device 200 (e.g., pointing forward or outward away from the plane of the outer surface 206) such that the spot lights 210 are configured to illuminate droplets sprayed from the misters 216 and the water nozzles 212.

For example, the spot lights 210 can be implemented using technology similar to lights that are used to create under-vehicle ground effects. It can be desirable to use independently controllable RGB lighting in order to recreate pyrotechnic effects. By having programmable RGB for the spot lights 210, various different firework types can be recreated by appropriately programming the spot lights 210. It is also desirable to use relatively high power lighting for the spot lights 210. For example, the spot lights 210 may have a power rating of at least 10 W outputting at least 500 Lumens, or have a power rating of at least 50 W outputting at least 1000-2000 Lumens.

In some embodiments, such as the embodiment illustrated in FIG. 2A, the strobe lights 208 and/or the spot lights 210 can be stationary with respect to the outer surface 206 on the front of the device 200. That is, the strobe lights 208 and the spot lights 210 can effectively recreate the visual impact of a rotary pyrotechnic without rotating with the water nozzles 212. However, in other embodiments, at least some of the strobe lights 208 and the spot lights 210 can also be mounted directly or indirectly to the main shaft 232 and rotated along with the water nozzles 212.

The panels 214 may be arranged to at least partially obstruct the strobe lights 208 and/or the spot lights 210. In some embodiments, the panels 214 may be frosted to any suitable degree (e.g., translucent), but other suitable configurations are possible, for example, the panels 214 may be transparent but tinted (e.g., with a specific color), semi-opaque, non-frosted, etc. In other embodiments, the panels 214 may not be included in the device 200, for example, when the device 200 is configured to be positioned at a sufficient distance from the viewers such that obstruction of the strobe lights and/or the spot lights 210 is not required.

The frosted panels 214 can allow some light from the strobe lights 208 and/or the spot lights 210 therebehind to pass through, while also randomly dispersing the light to make it more difficult to view the source of the lights (e.g., the strobe lights 208 and/or the spot lights 210) directly. Pyrotechnic devices may have a certain amount of "chaos" that is difficult to emulate. The frosted panels 214 can dissipate the light from the strobe lights 208 and/or the spot lights 210 to help recreate the "chaos" of pyrotechnics, for example, by eliminating at least some of the "precision" of bare lights (e.g., the relatively cylindrical or conical light radiating from the strobe lights 208 and/or the spot lights 210). Thus, the frosted panels 214 can alter the light, making the strobe lights 208 and/or the spot lights 210 look less like lights and obscure the actual strobe light 208 fixtures and/or the spot light 210 fixtures. By at least partially obscuring the source of light from the strobe lights 208 and/or the spot lights 210, the frosted panels 214 can in some cases create the appearance that the illuminated water droplets are a source of light.

Figure 3A:
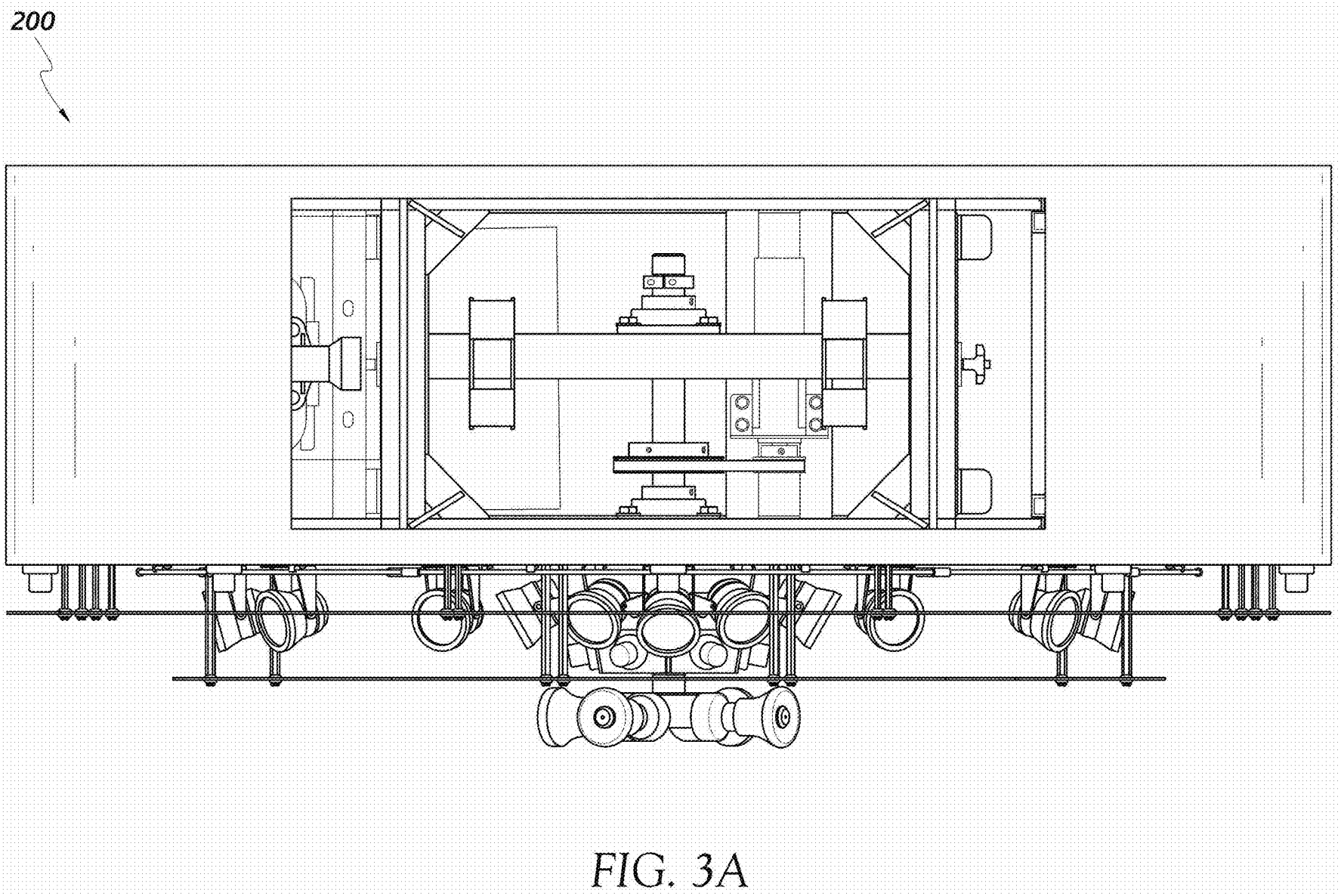
FIG. 3A is a partial cutaway top view of the device of FIG. 2A.
Figure 3B:
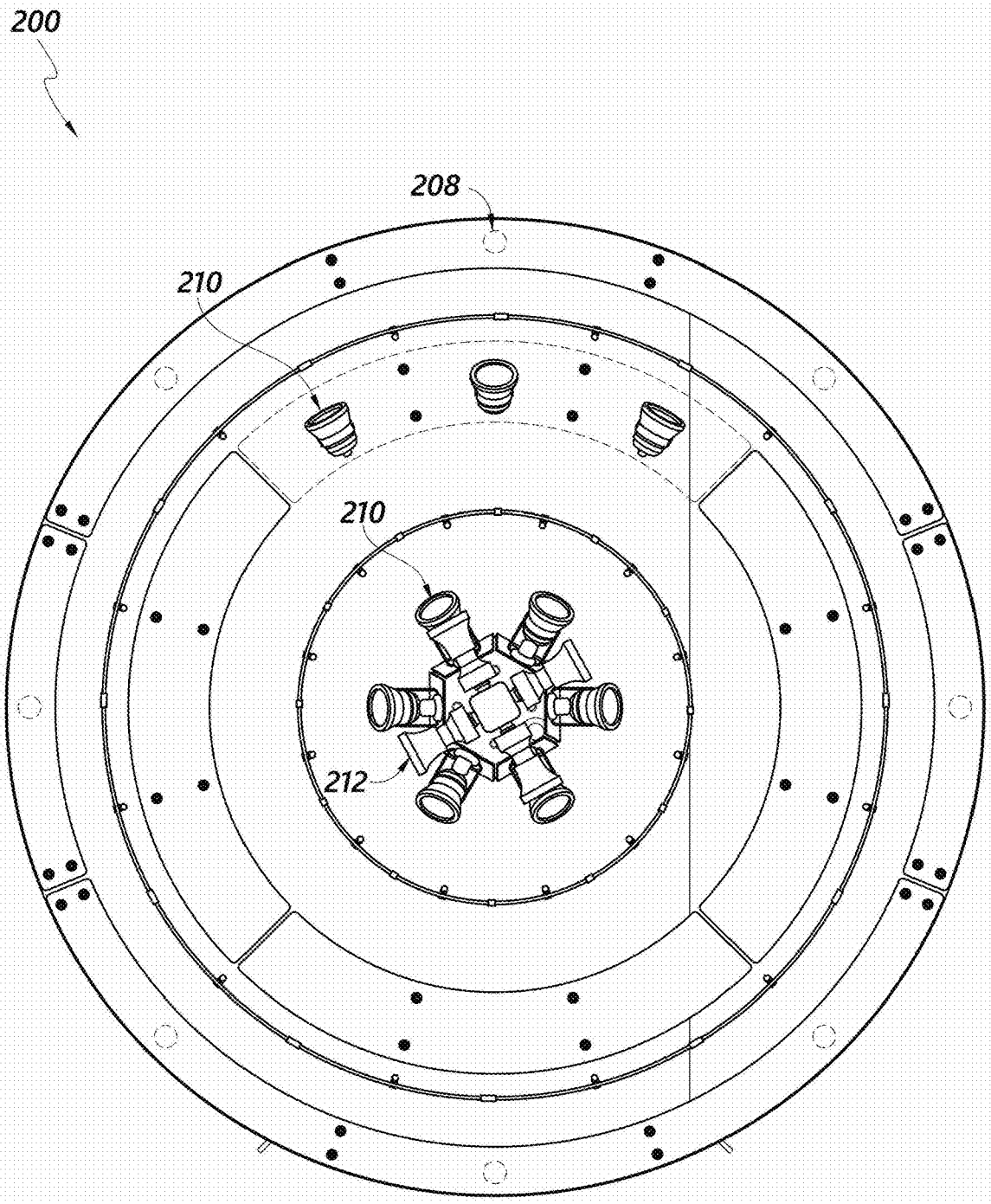
FIG. 3B is a front view of the device of FIG. 2A.
Figure 3C:
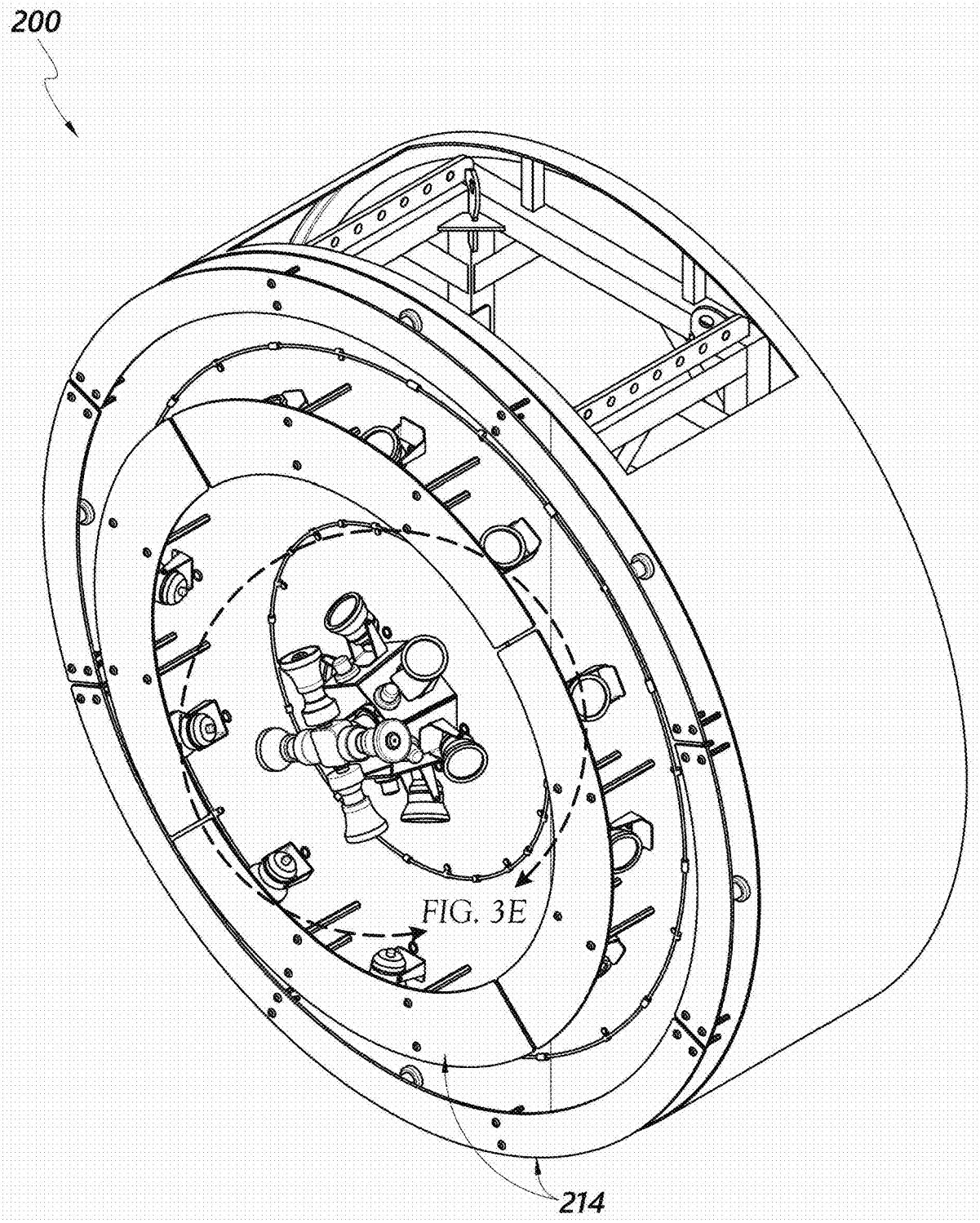
FIG. 3C is a partial cutaway perspective view of the device of FIG. 2A.
Figure 3D:
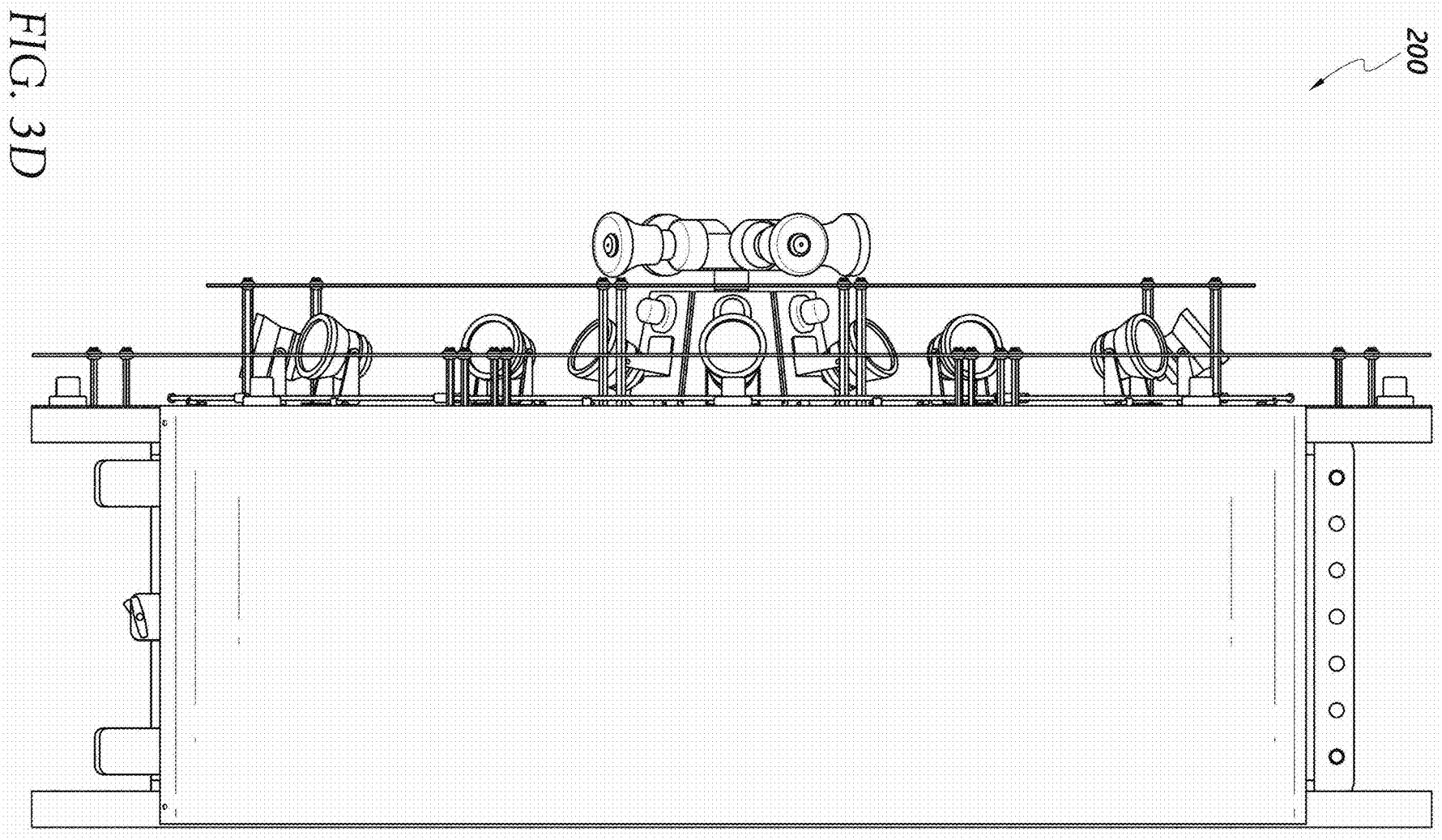
FIG. 3D is a partial cutaway side view of the device of FIG. 2A.
Figure 3E:
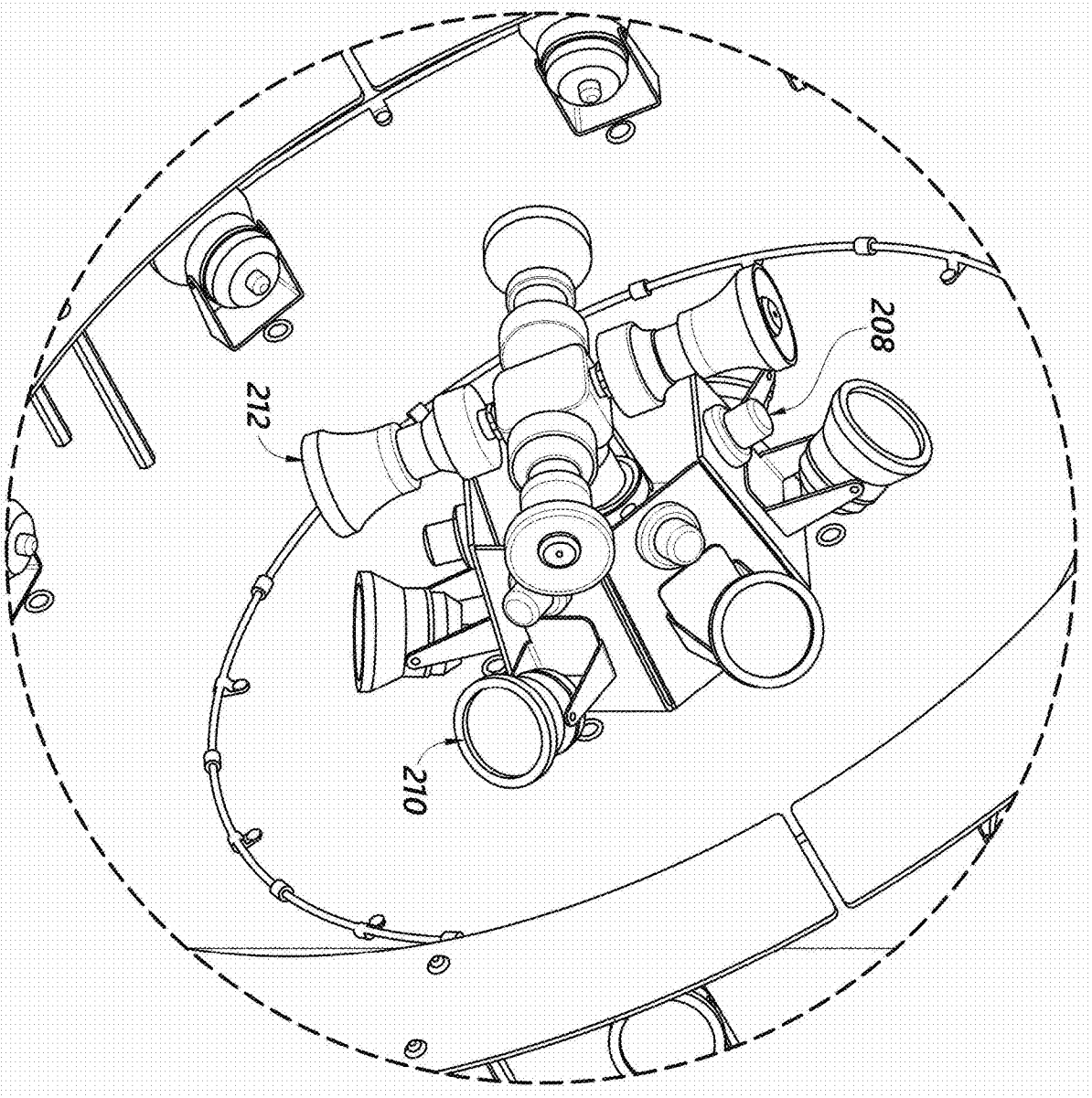
FIG. 3E is a close up view of the water nozzles on the front of the device of FIG. 2A.
Figure 3F:
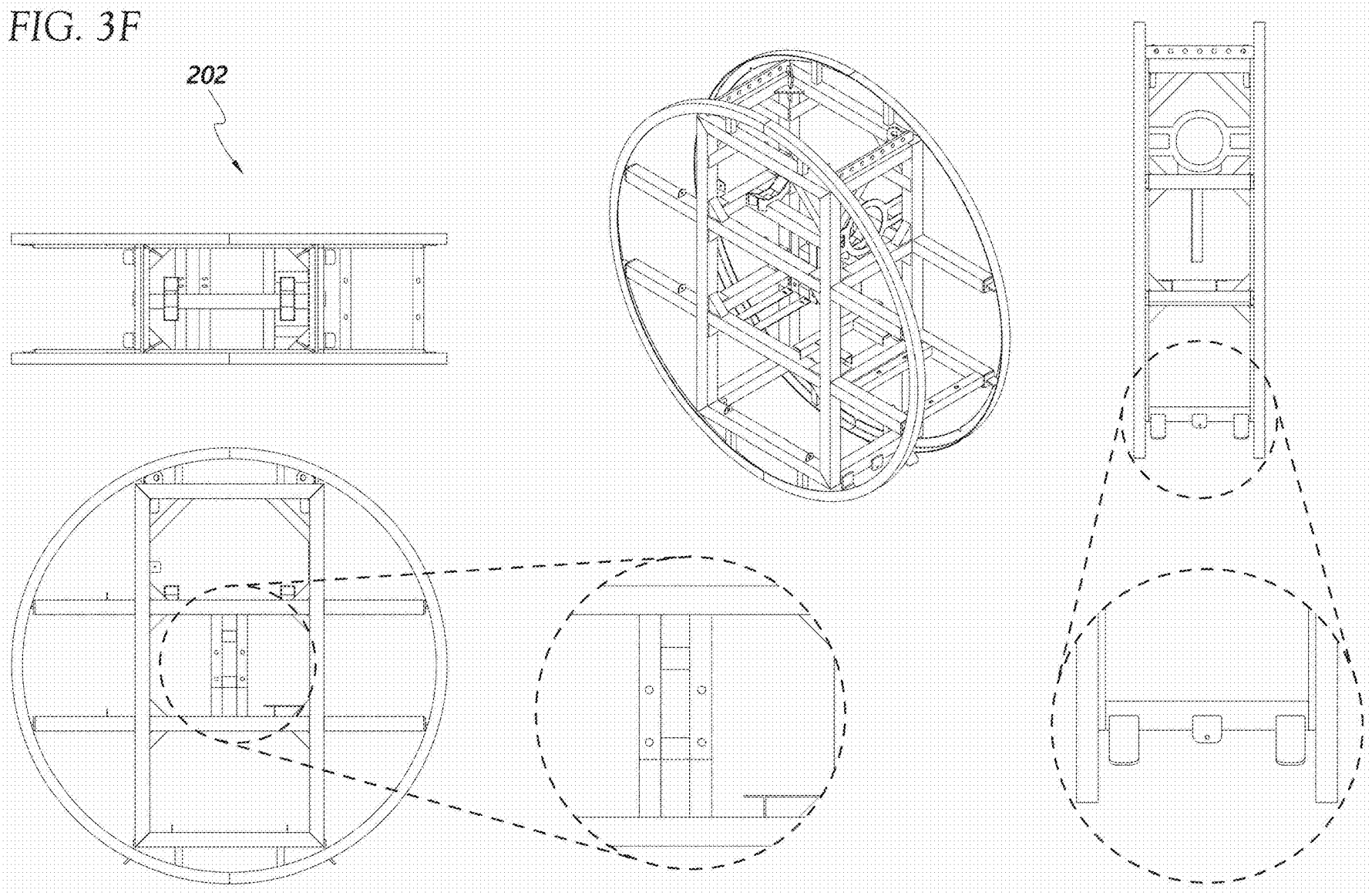
FIG. 3F provides a number of views of internal structural components of the device.
Figure 4:
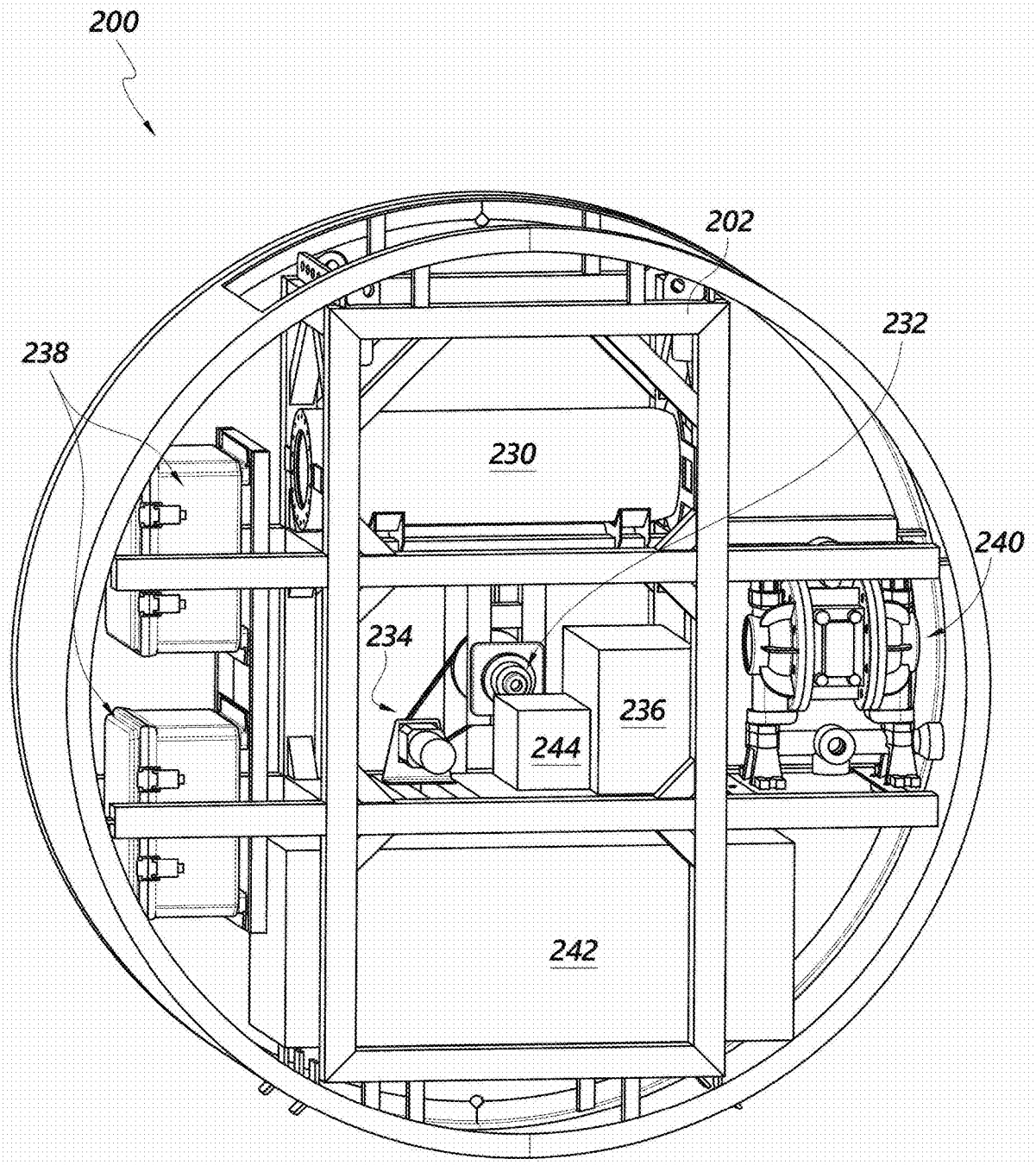
FIG. 4 is a cutaway backside view of the device illustrated in FIG. 2A.

FIGS. 3A-3F provide a number of views of the device 200 illustrated in FIGS. 2A-2B. In particular, FIG. 3A is a partial cutaway top view of the device 200, FIG. 3B is a front view of the device 200, FIG. 3C is a partial cutaway perspective view of the device 200, FIG. 3D is a partial cutaway side view of the device 200, FIG. 3E is a close up view of the water nozzles 212 on the front of the device 200, and FIG. 3F provides a number of views of internal structural components of the device 200. FIG. 4 is a cutaway backside view of the device 200 illustrated in FIG. 2A.

With reference to FIGS. 3A-F and 4, the device 200 further includes an air tank 230, the main shaft 232, an electric motor 234, a battery 236, a controller 238, a pneumatic water pump 240, a water tank 242 and a mist pump 244. Although not illustrated, a removable fabric or other material can be used to cover the back of the device 200 to provide access to the internal components in some embodiments. The embodiment of the device 200 illustrated in FIGS. 2A-4 is a self-contained unit that can be configured to create an illusion of a rotary pyrotechnic without the use of an external water supply or external power source. Thus, the device 200 can be moved within a theatrical space from above using a cable system, without the need for complex power and water feed connections that would make the repositioning of the device complex, if not, impractical. The cable system may have a weight limit defining the maximum weight of loads which can be safely moved using the system. Thus, one design factor for the device 200 is to keep the weight of the device, when loaded with water, under the maximum weight of the cable system. In some implementations, the weight limit may be about 600 lbs, and thus, it may be desirable to design the device 200 to have a weight less than 600 lbs.

In one embodiment, the device 200 may have an overall weight of less than 400 lbs., when fully loaded with water. Depending on the embodiment, the device 200 may have a weight of about 100 lbs., 150 lbs., 200 lbs., 250 lbs., 300 lbs., 350 lbs., 450 lbs., 500 lbs., 550 lbs., or 600 lbs. These example weights are not intended to be limiting, and aspects of this disclosure can be suitably implemented in any suitable device. In one example embodiment, the air tank 230 has a weight of about 31.5 lbs., the controller 238 has a weight of about 25 lbs., the electric motor 234 has a weight of about 25 lbs., the pneumatic water pump 240 has a weight of about 25 lbs., the water tank 242 has a weight of about 110 lbs., the strobe lights 208 have a weight of about 0.1 lbs. each, the spot lights 210 have a weight of about 0.05 lbs. each, and the water nozzles 212 have a weight of about 0.5 lbs. each.

One example of a cable system is a 4 point rigging system configured to move a load (e.g., the device 200) via four cables, each connected to the device's rigging attachment 203 and a separate point in the environment surrounding the working volume in which the device 200 can be moved. One challenge to the use of such cable systems is that the top of the device 200 may tilt as the device 200 approaches the outside of the range of possible movement for the system, creating a "bowl" effect. The cable system can control the pitch and/or tilt of the device 200 to overcome this effect. The cable system can also be configured to ensure that the front of the device 200 substantially faces the audience, such that the audience can experience the full effect of the illusion.

Figure 6:
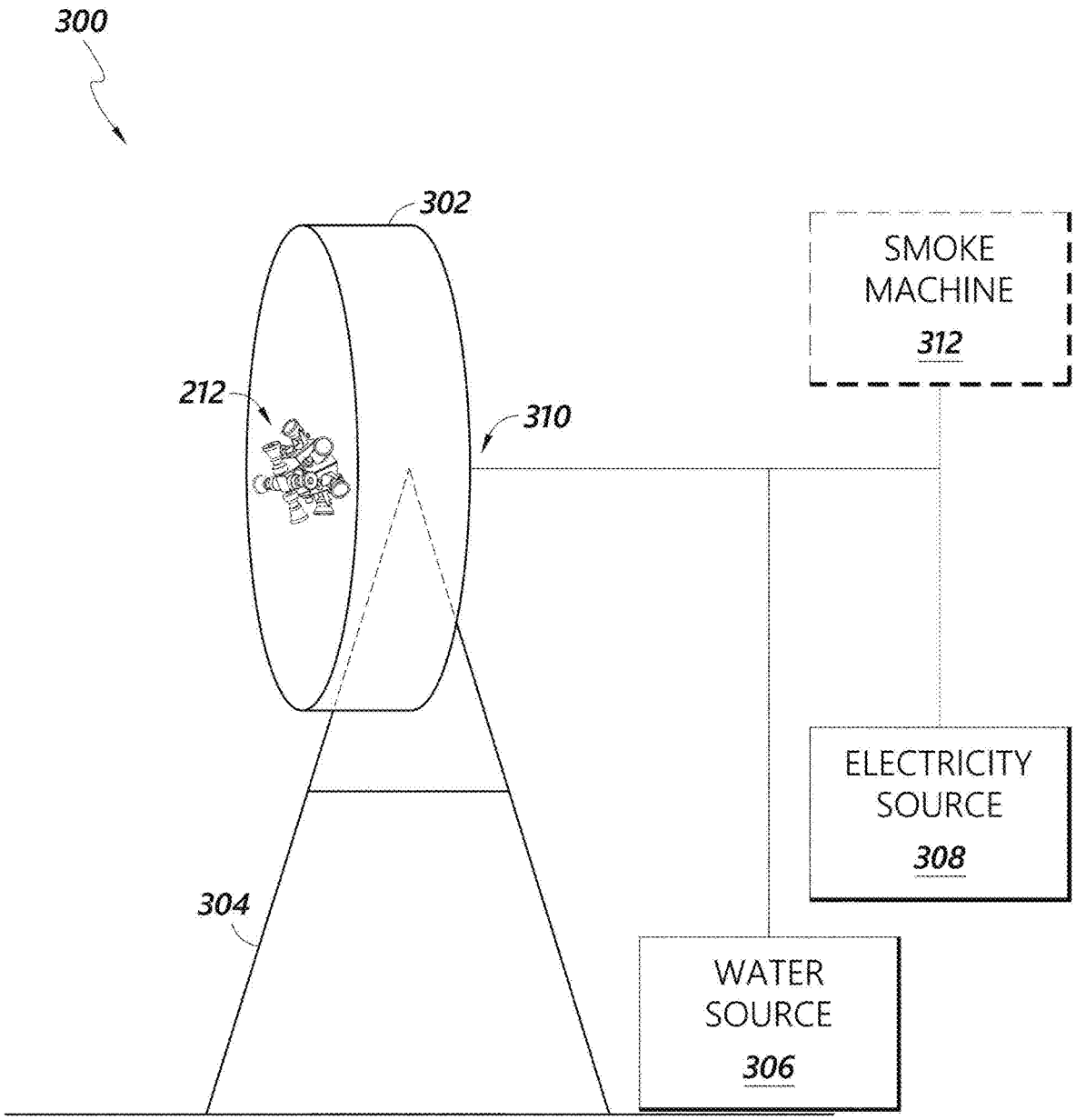
FIG. 6 illustrates an example device for creating an illusion of rotary pyrotechnics which can be installed in a permanent or fixed location in accordance with aspects of this disclosure.

In other embodiments, as shown in FIG. 6, a device for creating an illusion of rotary pyrotechnics can be installed in a permanent or fixed location. Thus, the device 300 in the FIG. 6 embodiment may not have the same weight design requirements and may not need to be self-contained. Details of these embodiments will be described below.

In certain embodiments, the water nozzles 212 can be rotated by supplying high-pressure water to the nozzles 212 along a curved path (e.g., a right angle turn) to help in rotation of the nozzles 212 around a central axle. However, the flow rate required to spin the nozzles 212 to get sufficient rotation speed (e.g., at a speed that simulates the speed of a rotary pyrotechnic, which may be in the range of 130-300 RPM) may not provide a desirable flow rate of water sprayed from of the water nozzles 212. That is, the water flow rate required to achieve a sufficient rotation speed of the water nozzles 212 may not provide the desired visual impact of the sprayed water for simulating the pyrotechnic exhaust of a rotary pyrotechnic. For example, the self-propelled embodiment may have a 27-30 gal/min flow rate to achieve the desire rotation speed and size of the water spray effect.

In addition, in embodiments that use water pressure and flow to spin the water nozzles 212, relatively high pressure (e.g., a pressure between 40-80 PSI) may be required to achieve the rotation speeds required for emulating a rotary pyrotechnic. However, relatively lower water pressure is desirable in order to lengthen the duration of the illusion and to improve the quality of illusion effects. That is, relatively high pressure (e.g., pressure levels required to achieve the desired rotation speeds) may result in water droplets that have too much aberration, leading to poor reflection of the light off of the sprayed water and providing a less realistic emulation of a rotary pyrotechnic.

Thus, certain embodiments, such as the device 200 of FIGS. 2A-4, separate the mechanisms for spinning the water nozzles 212 and pumping water to the water nozzles 212, in order to separately control the rotation speed and water pressure/flow rate.

For embodiments where the device 200 is self-contained, such as the device 200 of FIGS. 2A-4, the device may be limited by weight. The use of batteries and electric motors that have sufficient power for pumping water from the water tank 242 to the water nozzles 212 may be too heavy to meet weight limits while providing a sufficient effect duration, particularly for use of the device with a cable system. Thus, in the device 200 illustrated in FIGS. 2A-4, the device 200 uses the pneumatic water pump 240 to pump water to the water nozzles 212 instead of using an electric water pump. The pneumatic water pump 240 is coupled to the air tank 230 and is configured to use the air pressure from the air tank to power the pneumatic pump 240 when pumping water from a water supply (e.g., the water tank 242) to the water nozzles 212.

The electric motor 234 is configured to spin the main shaft 232 to rotate the main shaft 232, and thus the water nozzles 212, at the desired rotation speed. Thus, the water nozzles 212 can be spun without the use of water pressure as in the self-propelled embodiments (e.g., embodiments in which redirection of the water flowing to the water nozzles 212 is used to spin the water nozzles 212). This enables the device 200 to separately control the speed and spray pattern, allowing for more design options when creating the illusion, providing an advantage over self-propelled devices. The main shaft 232 can also include a water inlet and piping (e.g., the rotary joint 278 and wet shaft 280 shown in FIG. 5) used to connect the water nozzles 212 to the pneumatic pump 240. The main shaft 232 may also be coaxial with an axis 205 of the device 200 around which the water nozzles 212 are configured to rotate.

Depending on the embodiment, the water nozzles 212 can be implemented to have a similar structure to that of fire hose nozzles, garden hose nozzles, or high-flow rate washing nozzles, thereby providing a conical to cylindrical spray pattern. Flow and pressure changes to the water provided to the water nozzles 212 (e.g., controlled by the pneumatic water pump 240) can control the size and shape of spray from the water nozzles 212. The water nozzles 212 may be configured to create relatively large droplets off of which light emitted from the strobe lights 208 can reflect. In some non-limiting embodiments, the water nozzles 212 create droplets in the range of about 0.08 inches to about 0.20 inches in diameter. These dimensions are examples, however, and smaller and larger droplet sizes can be suitably implemented. The combination of the water particle size, the spray pattern, and the light emitted from the strobe lights 208 can thus emulate the particulates expelled from a rotary pyrotechnic.

The pneumatic water pump 240 may provide water to the water nozzles 212 at a pressure that creates a diameter of water spray of at least 5 ft. In some embodiments, the diameter of the water spray may be 6-7 ft. However, the diameter of the water spray may be greater or less the 5-7 ft., depending on the embodiment.

The misters 216 are coupled to the mist pump 244 that is separate from the pneumatic water pump 240. Since the mist created by the misters 216 has a lower pressure and flow rate compared with the water nozzles 212, a relatively small electric pump can be used as the mist pump 244 without significantly adding to the overall weight of the device 200. The misters 216 can be configured to provide a 360° spray. For example, the misters 216 may have a similar structure to misters used for drip irrigation. The flow rate of the misters 216 can depend on the pressure of water provided to the misters 216 by the water pump 240.

The device can include two rows of concentric misters 216 facing the perimeter of the device 200 which spray mist in a radial direction from the center of the device 200. Thus, the misters 216 may surround the water nozzles 212 from a front view of the device 200. In some embodiments, the misters 216 can provide a flat 360° spray pattern at a 45° angle with respect to the plane of the front surface of the device 200. The misters 216 can receive water from the water tank 242, atomize the water into droplets, and spray the droplets in a radial direction and/or in a forward or outward direction (e.g., parallel to the axis 205 of the device 200) to produce a mist of water that provides masking of the device 200 as well as the illusion of smoke produced by rotary pyrotechnics. The outer ring of misters 216 interacts with the mist produced by the inner ring of misters 216, softening the mist from the inner ring and improving the illusion. In some embodiments, the misters 216 can be configured to continue spraying mist after the water nozzles 212 have stopped spraying water, to continue the illusion of the smoke after illusion of the pyrotechnics has ended, creating the effect of lingering smoke after the pyrotechnics have expended all of their fuel.

The water sprayed from the water nozzles 212 can interact with the mist produced by the misters 216, disrupting the mist and improving the smoke illusion. The strobe lights 208 and spot lights 210 illuminate the mist from the center of the device 200, which can create or further enhance the smoke illusion. In some embodiments, the device 200 may include a fog machine (e.g., the fog machine 312 described in connection with FIG. 6) in place of the misters 216 which can be used to generate the smoke illusion.

With reference to FIG. 4, the internal components of the device 200 can be housed within a truss-line frame 202 defining bays for housing each of the components. Although not illustrated, the device 200 may also include pneumatic tubing and electrical controls connecting the various components of the device 200. The frame 202 can be formed of aluminum, provide a relatively light structure to support the load of the device 200, and allowing for a larger water tank 242 and battery 236 to extend the duration of the illusion for the same device 200 weight. In some embodiments, the water tank 242 may have a capacity to supply the water nozzles 212 with water to create an illusion of rotary pyrotechnics for at least 15 seconds, or in other embodiments, at least up to 30 seconds, 60 seconds, or longer.

FIG. 5 is an example block diagram illustrating an example control system for the device 200 of FIG. 2A in accordance with aspects of this disclosure. The control system (also referred to as a controller) includes an electrical control system 238 and a water control system 270. However, the division of the components of the control system into the electrical control system 238 and the water control system 270 is merely one example, and certain components can be swapped between the two systems and/or removed entirely from the control system depending on the embodiment.

The electrical control system 238 receives electrical power from one or more batteries 236 and is configured to power the strobe lights 208, the spot lights 210, and the motor 232 which rotates the main shaft 232. The electrical control system 238 includes a power distributer 254, a wireless transceiver 250, one or more strobe light dimmers 252, one or more spot light dimmers 256, a wireless enable receiver 258, one or more bypass switches 260, a DMX switch 262, a pilot relay 264, and a motor controller 266.

The power distributor 254 may be configured to provide power to each of the components of the device 200 by selectively providing power thereto. The wireless DMX transceiver 250 is configured to wirelessly communicate with a DMX controller (not illustrated) to, for example, receive a control signal or command to initiate the illusion of rotary pyrotechnics and/or receive a kill signal to terminate the illusion. Other signals can also be received via the DMX wireless transceiver 250, such as instructions to run certain instructions to recreate different rotary pyrotechnic illusions. These different instructions can include, for example, different lighting patterns/colors, different water pressures to achieve smaller or larger diameter spray, different main shaft rotation speeds, etc.

The power distributor 254 can provide power to each of the strobe light dimmer 252, the spot light dimmer(s) 256, the DMX switch 262, the pilot relay 264, and the motor controller 266 based on a signal received from the wireless DMX transceiver 250. The strobe light dimmer 252, the spot light dimmer(s) 256, and the DMX switch 262 can be daisy chained together to form a communication chain for instructions received via the wireless DMX transceiver 250. Thus, each of these components can individually control their respective components using the instructions received via the DMX daisy chain.

In particular, the strobe light dimmer 252 is configured to control the strobe lights 208 by selectively providing power thereto based on the signal received from the wireless DMX transceiver 250. Similarly, the spot light dimmer(s) 256 are configured to control the spot lights 210 by selectively providing power thereto based on the signal received from the wireless DMX transceiver 250. As described above, the spot light dimmer(s) 256 can change the RGB values of the spot lights 210 individually to reproduce a large number of different colors to recreate the lighting of a rotary pyrotechnic.

The DMX switch 262 is configured to control a solenoid value 274 (a component of the water control system 270) to control the flow of compressed air from the air tank 230 to the pneumatic pump 240 to control the flow of water to the water nozzles 212. The DMX switch 262 is also configured to control the pilot relay 264 to control the mist pump 244 to control the flow of water to the misters 216. The DMX switch 262 is further configured to control the motor controller 266 to control the motor 232 to spin the main shaft 232 at a desired rotation speed around the axis of the main shaft 232 (e.g., which may be coaxial with the axis 205 of the device 200).

The bypass switches 260 are configured to allow for testing of the device 200 when there is no DMX system safety enable available. During normal operation, the device 200 may only initiate the pyrotechnic illusion when the DMX enable is enabled and a latching switch on a control transmitter (not illustrated) in communication with the wireless DMX transceiver 250 is also enabled. During testing, it is possible to physically press and hold the bypass switches 260 in order to operate either the misters 216 or the water nozzles 212 and motor 232.

The water control system 270 includes the air tank 230, a first regulator 272, the solenoid value 274, the pneumatic pump 240, a flow valve 276, a rotary joint 278, a wet shaft 280, the plurality of nozzles 212, the water tank 242, the mist pump 244, a second regulator 282, and the misters 216.

The air tank 230 is configured to store compressed air and provide the compressed air to the pneumatic pump 240 to drive the pneumatic pump 240. The first regulator 272 is configured to regulate the pressure of the air output from the air tank 230 to a predetermined pressure level (e.g., 70 PSI). As described above, the solenoid valve 274 is configured to selectively provide the compressed air from the air tank 230 to the pneumatic pump 240 based on a signal received from the DMX switch 262 to selectively drive the pneumatic pump 240.

When the pneumatic pump 240 receives compressed air from the air tank 230 via the solenoid 274, the pneumatic pump 240 is configured to pump water from the water tank 242 to the main nozzles 212 via the flow valve 276, the rotary joint 278, and the wet shaft 280. The flow valve 276 can be configured to prevent water from flowing to the water nozzles 212 when the device 200 is not in use. The rotary joint 278 and the wet shaft 280 provide a path for water to flow from the pneumatic pump 276 to the water nozzles 212. For example, the main shaft 232 may include the rotary joint 278 and the wet shaft 278, allowing the main shaft 232 to rotate the water nozzles 212, while also providing a path for water to flow therethrough.

The mist pump 244 is configured to pump water from the water tank 242 to the misters 216 via the second regulator 282 based on a signal received from the DMX switch 262 via the pilot relay 264. The second regulator 282 is configured to regulate the pressure of the water pumped from the mist pump 244 to a predetermined level to be supplied to the misters 216.

In some embodiments, speakers (not illustrated) can be used to provide sound effects to improve the illusion of the rotary pyrotechnic. For example, the device 200 can include one or more speakers to reproduce sound effects similar to those of a rotary pyrotechnic device. However, in other embodiments, the sound effects can be provided by speakers separate from the device 200 within the device's 200 environment (e.g., speakers forming a part of the aquatic show, within a pool party environment, etc.).

Although the device 200 of FIGS. 2A-5 has been described primarily in connection with a self-contained or otherwise mobile embodiment (e.g., that can be moved using a cable system such as a 3D flying system), in other embodiments, a device for creating an illusion of rotary pyrotechnics can be installed into a permanent or otherwise static installation. FIG. 6 illustrates an example device 303 for creating an illusion of rotary pyrotechnics can be installed in a permanent or fixed location 300 in accordance with aspects of this disclosure. In one implementation, the device 302 can be permanently installed in a pool party environment or other club environment 300.

Similar to the device 200 of FIGS. 2A-5, the device 302 includes one or more water nozzles 212 arranged on a front face of the device 302. The device 302 can include many of the same components of the device 200 of FIGS. 2A-5, and thus, a detailed description of the similar components for the device 302 may not be provided below.

As shown in FIG. 6, the device 302 can be supported by a fixed structure 304 configured to support the device 302. Although the fixed structure 304 is illustrated as a freestanding structure in FIG. 6, the fixed structure 304 can be embodied in many different ways including being supported by a building or as part of another fixed structure within the environment 300.

Since the device 302 does not need to be moved within the environment, the routing of water and/or electricity from external sources may be simplified compared to the more mobile embodiments described herein. In addition, the weight of the device 302 may be less than a similar self-contained mobile device since the device 302 need not include water storage features and/or compressed air features. Accordingly, a water source 306 and/or an electricity source 308 can be located outside of the device 302 itself. Since the water source 306 and/or the electricity source 308 are not contained within the device 302 the size of the device can be reduced compared to a self-contained embodiment. The device 302 can also include one or more connectors 310 configured to connect the device to the water source 306 and/or the electricity source 308. In addition, there is no limit to the length of effect duration, so the illusion can be run continuously providing more flexibility in how the illusion can be incorporated into an entertainment production.

The device 302 may further comprise an optional fog machine 312 (also referred to as a smoke machine). In certain embodiments, the fog machine 312 can be configured to generate a relatively dense vapor from one or more apertures in the device 302 that creates the illusion of the smoke produced by a rotary pyrotechnic. The fog machine 312 can be synchronized with the water nozzles 212 to emit the vapor at the same time as the water nozzles 212 sprays water. In the stationary embodiment of FIG. 6, the fog machine 312 can be included as a part of the device 302 or can be located outside of the device 302. In embodiments including the fog machine 312, the misters 216, mist pump 244 and associated components can be removed from the device 302. In addition, in certain embodiments, the self-contained device 200 of FIGS. 2-4 can also be modified to include a fog machine 312 in pace of the misting system.

Figure 7A:
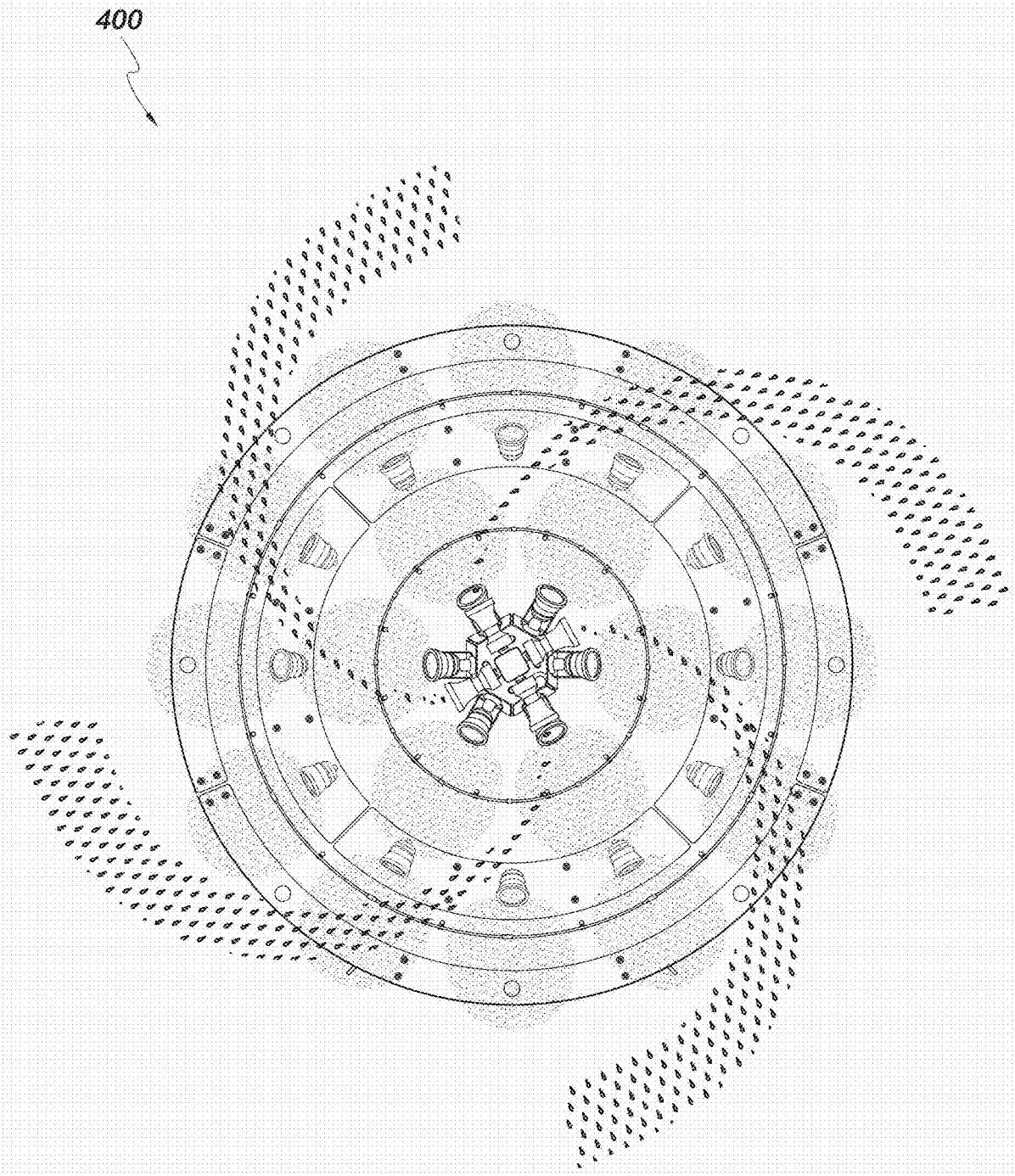
FIGS. 7A, 7B, and 7C include a line drawing, a color photo, and a black and white photo illustrating the visual effects of an embodiment of the device of FIG. 2A in accordance with aspects of this disclosure.
Figure 7B:
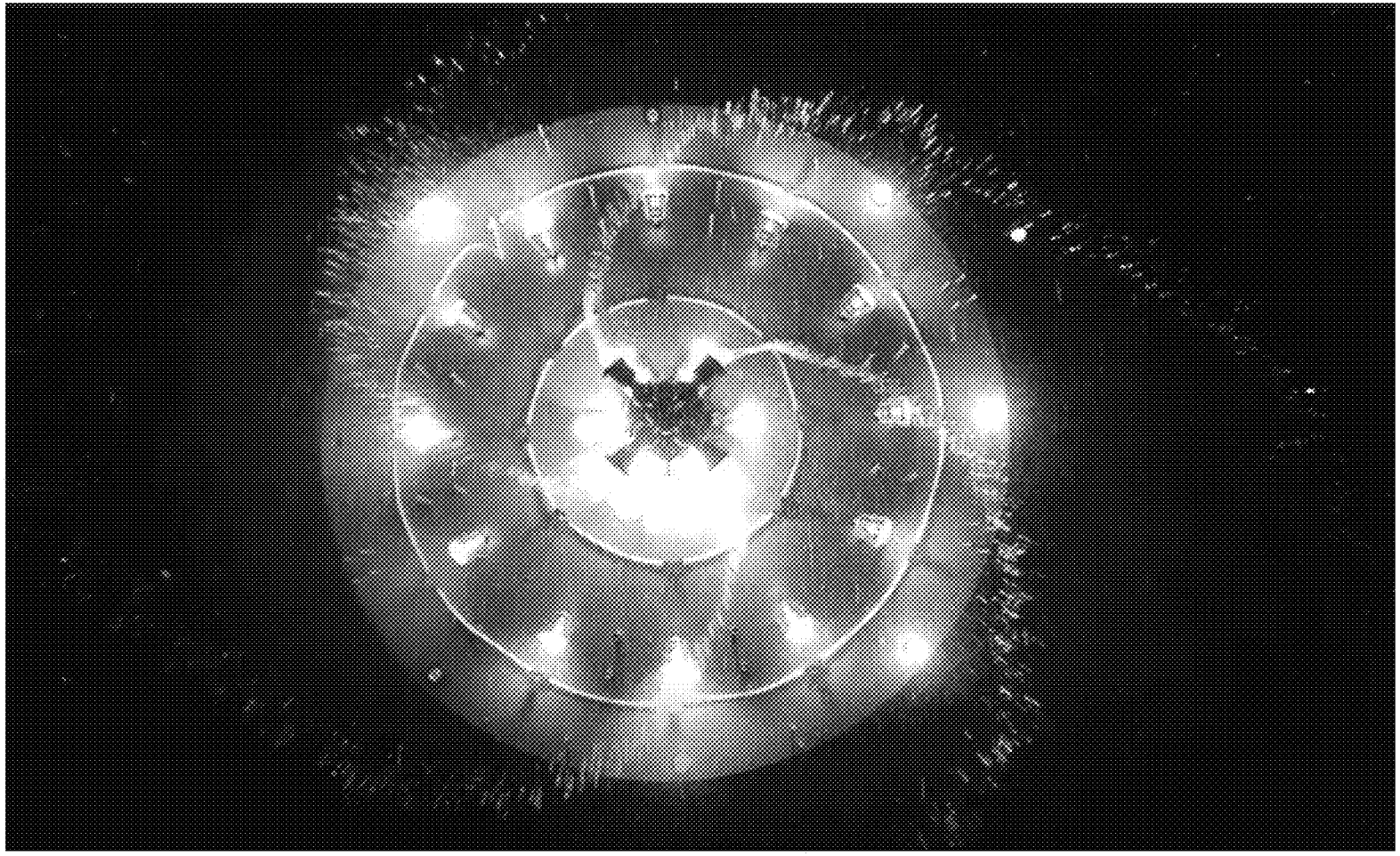
Figure 7C:
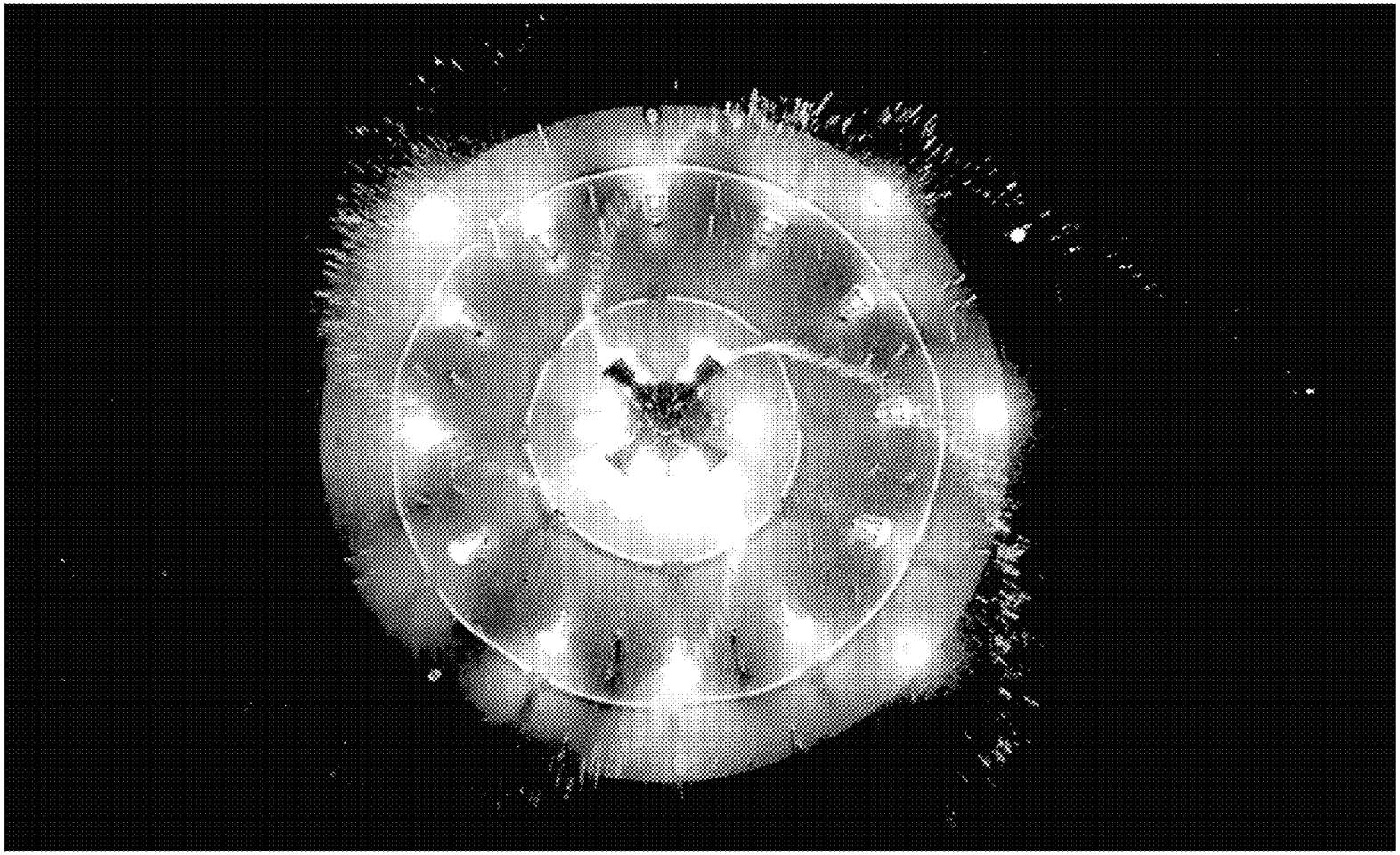

FIGS. 7A, 7B, and 7C include a line drawing, a color photo, and a black and white photo illustrating the visual effects of an embodiment of the device 200 of FIG. 2A in accordance with aspects of this disclosure. As shown in FIGS. 7A-7C, water sprayed from the rotating water nozzles 212 creates a spiral pattern of water, which reflects light from the strobe lights 208 and the spot lights 210. In addition, the misters 216 produce a background mist that creates an illusion of the smoke produced by a rotary pyrotechnic.

Additional Embodiments

It will be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

Many other variations than those described herein will be apparent from this disclosure. For example, depending on the embodiment, certain acts, events, or functions of any of the algorithms described herein can be performed in a different sequence, can be added, merged, or left out altogether (for example, not all described acts or events are necessary for the practice of the algorithms). Moreover, in certain embodiments, acts or events can be performed concurrently, for example, through multi-threaded processing, interrupt processing, or multiple processors or processor cores or on other parallel architectures, rather than sequentially. In addition, different tasks or processes can be performed by different machines and/or computing systems that can function together.

The elements of a method, process, or algorithm described in connection with the embodiments disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC. The ASIC can reside in a user terminal. In the alternative, the processor and the storage medium can reside as discrete components in a user terminal.

All of the methods and processes described herein may be embodied in, and partially or fully automated via, software code modules executed by one or more general purpose computers. For example, the methods described herein may be performed by the computing system and/or any other suitable computing device. The methods may be executed on the computing devices in response to execution of software instructions or other executable code read from a tangible computer readable medium. A tangible computer readable medium is a data storage device that can store data that is readable by a computer system. Examples of computer readable mediums include read-only memory, random-access memory, other volatile or non-volatile memory devices, CD-ROMs, magnetic tape, flash drives, and optical data storage devices.

What is claimed is:

1. A device, comprising:

at least one nozzle configured to rotate about an axis of the device and spray liquid away from the axis of the device;

a liquid supply configured to provide the liquid to the at least one nozzle;

at least one mister arranged on an outer surface of the device and configured to produce a mist; and one or more illumination sources configured to illuminate the liquid sprayed from the at least one nozzle and the mist produced by the at least one mister.

2. The device of claim 1, wherein the:

at least one mister surrounds the at least one nozzle from a front view, and wherein the at least one mister is configured to receive liquid from the liquid supply, atomize the liquid into droplets, and spray the droplets.

3. The device of claim 1, wherein the one or more illumination sources comprise:

a plurality of strobe lights positioned along a perimeter of the device, the strobe lights configured to illuminate the liquid sprayed from the at least one nozzle; and a plurality of spot lights configured to illuminate the mist produced by the at least one mister.

4. The device of claim 3, wherein the at least one mister is further configured to continue producing the mist after the at least one nozzle has stopped spraying liquid.

5. The device of claim 3, wherein the at least one nozzle is arranged to face a radial direction, and wherein the spot lights are arranged to face a direction forming an angle with the radial direction.

6. The device of claim 1, further comprising:

a main shaft coaxial with the axis of the device and attached to the at least one nozzle; and a motor configured to spin the shaft so as to rotate the at least one nozzle about the axis.

7. The device of claim 1, further comprising:

a frame defining a perimeter of the device, the at least one nozzle and the one or more illumination sources attached to the frame, the frame configured to be attached to a fixed structure configured to support the device, wherein the liquid supply comprises a connector configured to receive the liquid from a liquid tank external to the device.

8. The device of claim 7, further comprising:

a main shaft coaxial with the axis of the device and attached to the at least one nozzle; and a motor configured to spin the shaft so as to rotate the at least one nozzle about the axis.

9. The device of claim 1, wherein the liquid is supplied from the liquid supply to the at least one nozzle along a curved path.

10. The device of claim 1, wherein the at least one nozzle is configured to rotate about the axis of the device when the liquid is supplied to the at least one nozzle greater than a threshold pressure.

11. The device of claim 1, further comprising:

a frame housing the liquid supply, wherein the liquid supply comprises a liquid tank located within the frame;

a compressed air tank configured to store compressed air;

a pneumatic liquid pump configured to pump liquid from the liquid tank to the at least one nozzle using the compressed air; and a rigging attachment configured to be coupled to a cable system, the cable system configured to move the device in space, wherein the device is configured to create the illusion of rotary pyrotechnics without any external liquid supply.

12. The device of claim 11, further comprising:

a battery configured to power the one or more illumination sources;

a wireless receiver configured to receive a command to initiate the illusion of rotary pyrotechnics; and a controller configured control the pneumatic liquid pump and the lighting system to initiate the illusion of rotary pyrotechnics in response to the command received via the wireless receiver, wherein the liquid tank has a capacity to supply the at least one nozzle with the liquid to create the illusion of rotary pyrotechnics for at least 15 seconds.

13. The device of claim 1, wherein the liquid supply comprises a liquid tank within the device.

14. The device of claim 1, wherein the liquid supply comprises a connector configured to receive the liquid from a liquid tank external to the device.

15. The device of claim 1, wherein the device is configured to create the illusion of rotary pyrotechnics without any external liquid supply.

16. The device of claim 1, wherein the device is configured to create the illusion of rotary pyrotechnics without the use of pyrotechnics.

17. A device for creating an illusion of rotary pyrotechnics, the device comprising:

at least one nozzle configured to rotate about an axis of the device and spray liquid away from the axis of the device while rotating;

a liquid supply configured to provide the liquid to the at least one nozzle;

a fog machine configured to emit a vapor from one or more apertures in the device at the same time the at least one nozzle sprays the liquid; and one or more illumination sources configured to illuminate the liquid sprayed from the at least one nozzle and the vapor emitted by the fog machine.

18. The device of claim 17, further comprising:

a frame defining a perimeter of the device, the at least one nozzle and the one or more illumination sources attached to the frame, the frame configured to be attached to a fixed structure configured to support the device, wherein the liquid supply comprises a connector configured to receive the liquid from a liquid tank external to the device.

19. The device of claim 18, further comprising:

a main shaft coaxial with the axis of the device and attached to the at least one nozzle; and a motor configured to spin the shaft so as to rotate the at least one nozzle about the axis.

20. The device of claim 17, wherein the at least one nozzle is arranged to face a radial direction such that the at least one nozzle is configured to spray the liquid in the radial direction, and wherein the one or more illumination sources are arranged to face a direction forming an angle with the radial direction such that the spot lights are configured to illuminate the vapor produced by the fog machine.

21. The device of claim 17, further comprising:

a main shaft coaxial with the axis of the device and attached to the at least one nozzle; and a motor configured to spin the shaft so as to rotate the at least one nozzle about the axis.

22. The device of claim 17, wherein the liquid supply comprises a liquid tank within the device.

23. The device of claim 17, wherein the liquid supply comprises a connector configured to receive the liquid from a liquid tank external to the device.

24. The device of claim 17, wherein the device is configured to create the illusion of rotary pyrotechnics without any external liquid supply.

25. The device of claim 17, wherein the device is configured to create the illusion of rotary pyrotechnics without the use of pyrotechnics.

26. A method, comprising:

providing liquid to at least one nozzle while the at least one nozzle rotates about an axis of a device in order to spray liquid away from the axis of the device;

providing liquid to at least one mister arranged on an outer surface of the device to produce a mist; and illuminating the liquid sprayed from the at least one nozzle and the mist produced by the at least one mister.

27. The method of claim 26, further comprising:

continuing to provide liquid to the at least one mister to produce the mist after the at least one nozzle has stopped spraying liquid.

28. The method of claim 26, further comprising:

rotating the at least one nozzle about the axis of the device using a motor.

29. The method of claim 26, wherein the liquid is provided to the at least one nozzle from a liquid tank external to the device.

30. The method of claim 26, wherein the liquid is provided to the at least one nozzle from a liquid tank within the device.

31. The method of claim 26, further comprising providing a vapor from one or more apertures in the device at the same time as spraying the liquid away from the axis of the device.

* * * * *